US007318323B2

(12) United States Patent
Tatsui et al.

(10) Patent No.: US 7,318,323 B2
(45) Date of Patent: Jan. 15, 2008

(54) ICE-MAKING DEVICE

(75) Inventors: Hiroshi Tatsui, Shiga (JP); Tadashi Adachi, Shiga (JP); Mitoko Ishita, Aichi (JP); Toyoshi Kamisako, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 322 days.

(21) Appl. No.: 10/548,384

(22) PCT Filed: Mar. 10, 2004

(86) PCT No.: PCT/JP2004/003065

§ 371 (c)(1),
(2), (4) Date: Sep. 8, 2005

(87) PCT Pub. No.: WO2004/081470

PCT Pub. Date: Sep. 23, 2004

(65) Prior Publication Data

US 2006/0168983 A1 Aug. 3, 2006

(30) Foreign Application Priority Data

| | | |
|---|---|---|
| Mar. 11, 2003 | (JP) | 2003-064899 |
| Oct. 14, 2003 | (JP) | 2003-353468 |
| Dec. 3, 2003 | (JP) | 2003-404178 |
| Dec. 3, 2003 | (JP) | 2003-404180 |
| Dec. 3, 2003 | (JP) | 2003-404184 |

(51) Int. Cl.
*F25C 5/04* (2006.01)

(52) U.S. Cl. ..... 62/320; 62/356

(58) Field of Classification Search ..... 62/66–74, 62/320, 340–356
See application file for complete search history.

(56) References Cited

U.S. PATENT DOCUMENTS

| | | | | |
|---|---|---|---|---|
| 3,135,101 | A * | 6/1964 | Nigro | 62/344 |
| 3,475,921 | A * | 11/1969 | Pietrzak et al. | 62/320 |
| 7,093,456 | B2 * | 8/2006 | Shoukyuu et al. | 62/320 |

FOREIGN PATENT DOCUMENTS

| | | |
|---|---|---|
| JP | 3-37377 | 4/1991 |
| JP | 4-113868 | 10/1992 |
| JP | 6-201247 | 7/1994 |
| JP | 8-086548 | 4/1996 |
| JP | 2001-263887 | 9/2001 |
| JP | 2001-355946 | 12/2001 |
| JP | 2002-139268 | 5/2002 |
| JP | 2002-350019 | 12/2002 |

* cited by examiner

*Primary Examiner*—William E. Tapolcai
(74) *Attorney, Agent, or Firm*—Wenderoth, Lind & Ponack, L.L.P.

(57) ABSTRACT

A compact ice-making device is provided for making ice chips of varied shapes for use in glasses of whiskey and water, and the like purposes. Ice is made using an ice-making vessel (13) for making a plank-like block of ice with a shaft (18) inserted in advance in the vessel, the shaft (18) having ribs (18A) extending substantially radially from a rotating axis. Upon completion of the ice making, a gear unit (20) connected to the shaft (18) is driven by a motor to rotate the shaft (18), which cracks and divides the plank-like ice block into ice chips of varied shapes.

44 Claims, 25 Drawing Sheets

FIG. 26 - PRIOR ART
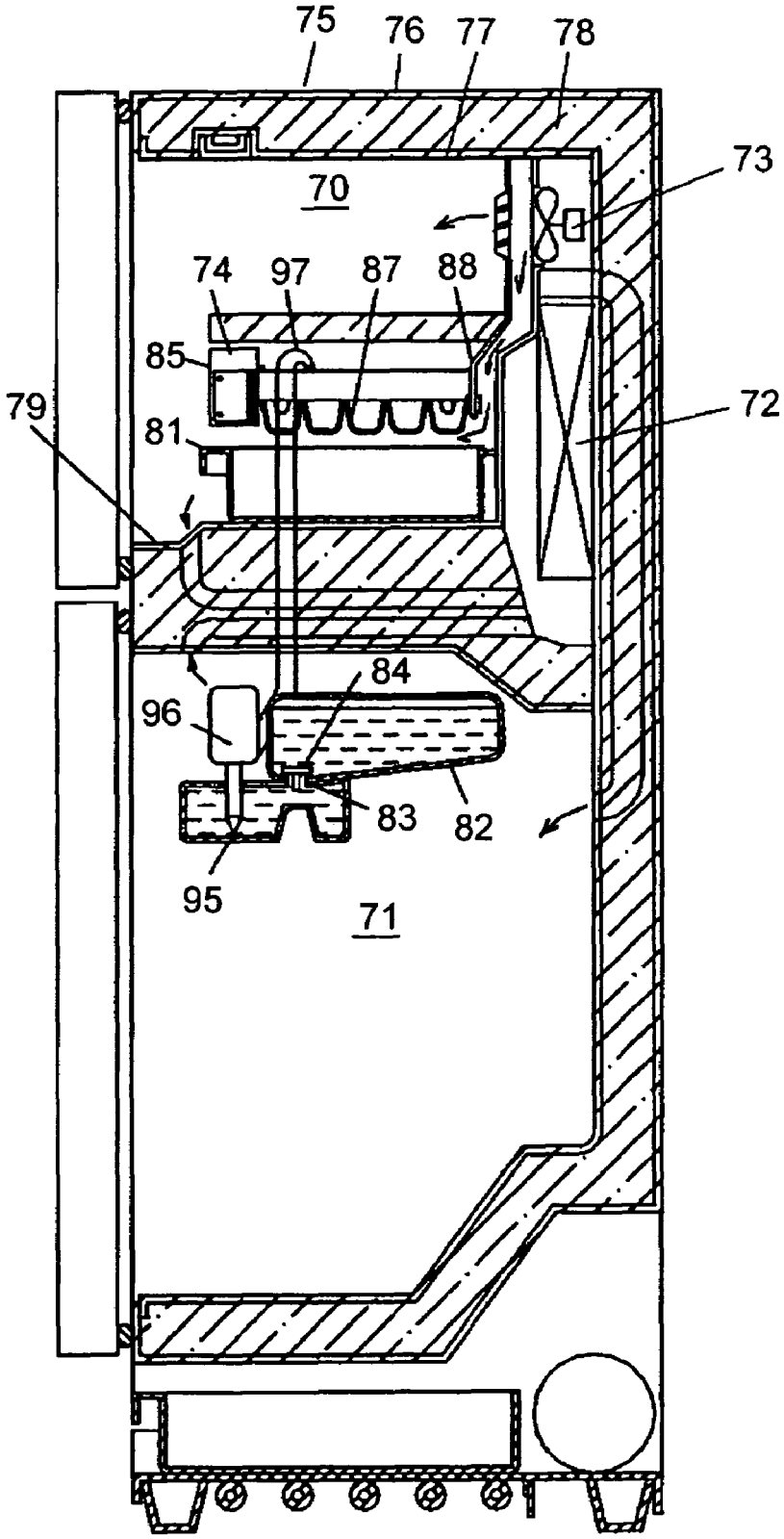

FIG. 27 - PRIOR ART
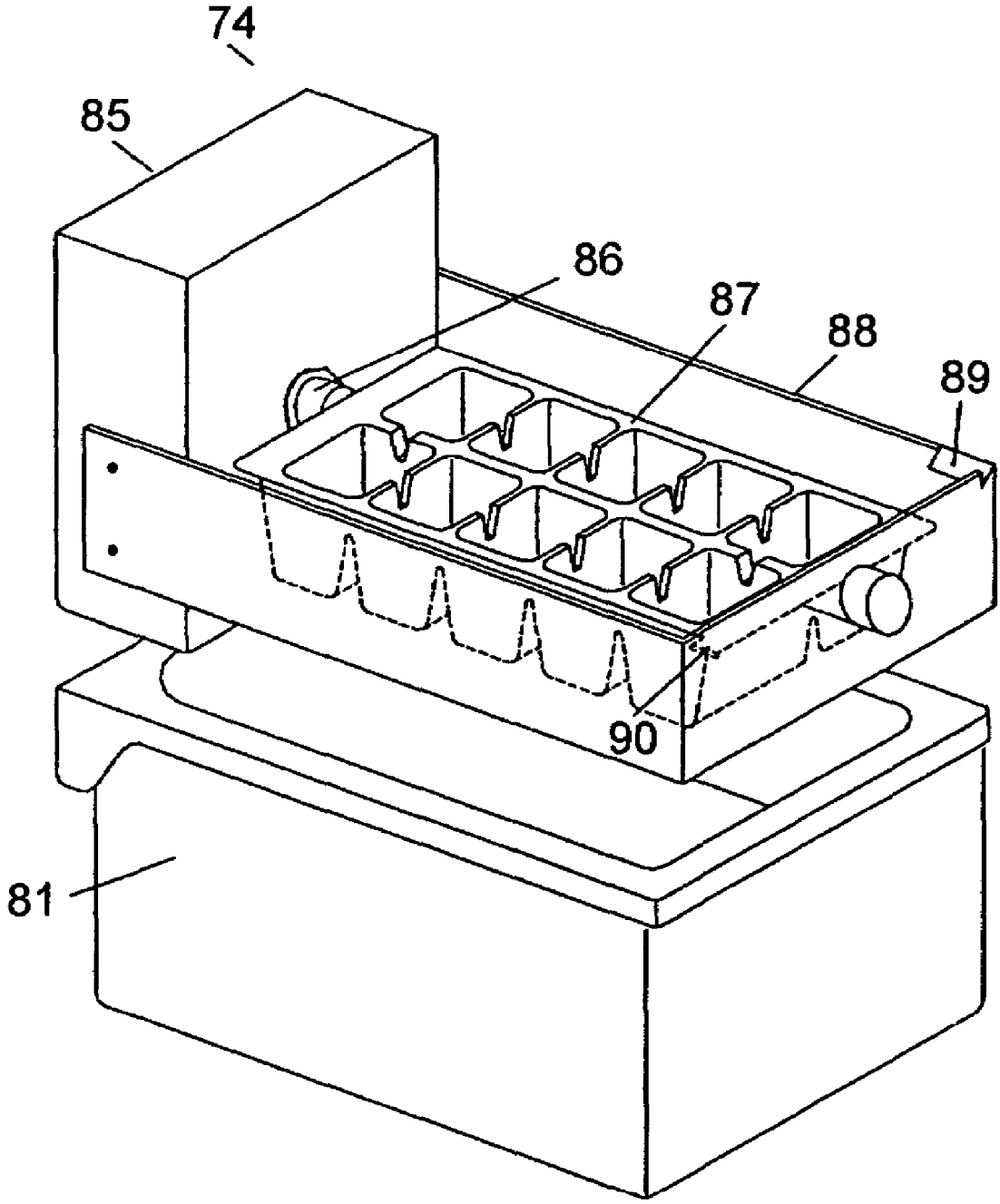

FIG. 28 - PRIOR ART
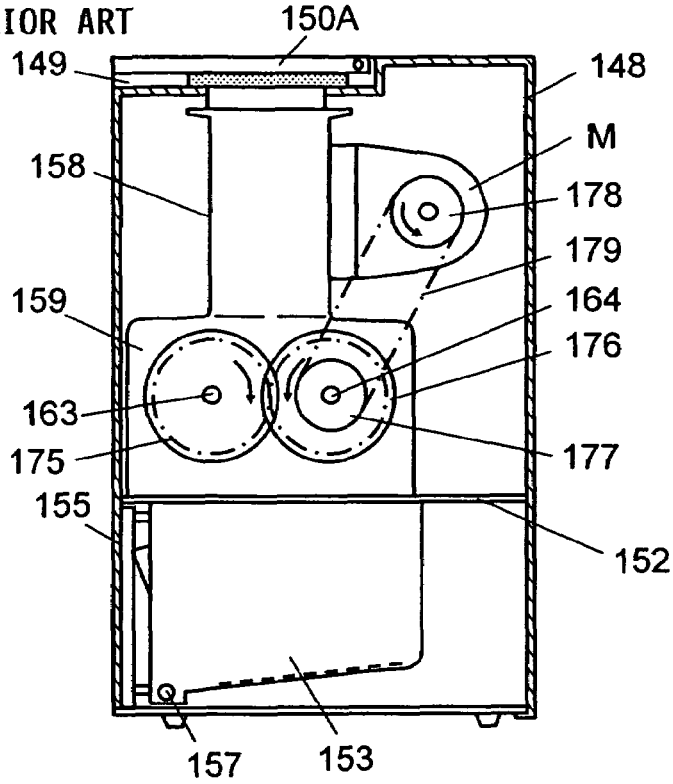
FIG. 29 - PRIOR ART
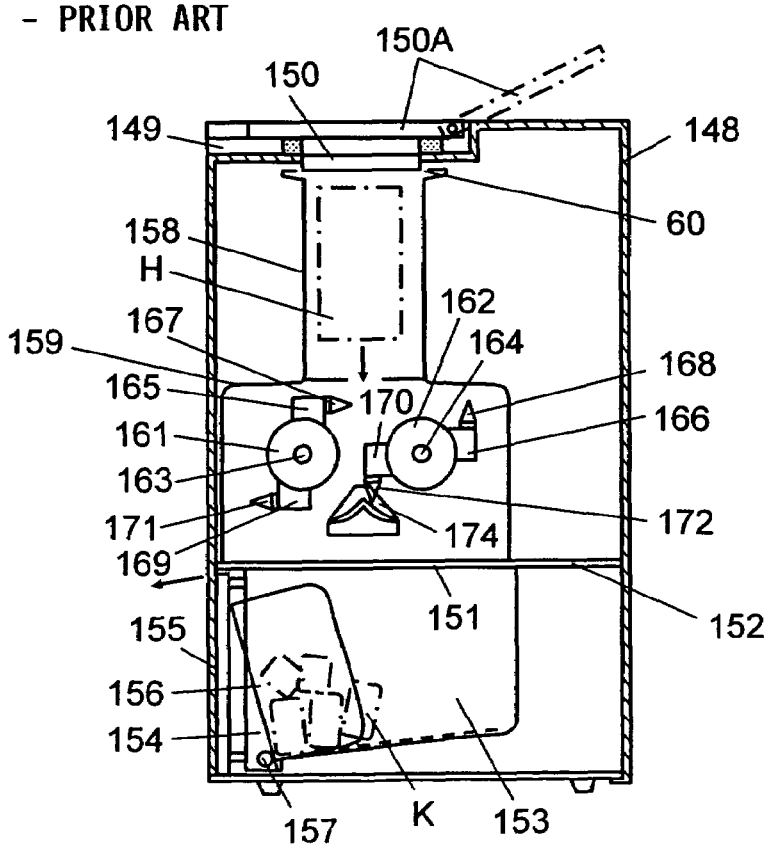

ICE-MAKING DEVICE

This application is a U.S. national phase application of PCT International Application PCT/JP2004/003065.

TECHNICAL FIELD

The present invention relates to an ice-making device capable of making ice chips of varied shapes.

BACKGROUND ART

In household refrigerators and the like, there has hitherto been a wide use of automatic ice-making device (hereinafter referred to as ice-making device) for storing and freezing water supplied from a water-supply pipe into an ice-making vessel, and releasing the produced ice cubes by means of a drive unit which turns the ice-making vessel upside down.

Description is provided hereinafter of one such ice-making device of the prior art with reference to the accompanying drawings. FIG. 26 shows an overall structure of the ice-making device in the conventional refrigerator.

FIG. 27 is a structural illustration of an ice-making unit of the conventional ice-making device. As shown in FIG. 26 and FIG. 27, main cabinet 75 of the refrigerator comprises outer cabinet 76, inner cabinet 77, and insulating material 78 filled in a space between outer cabinet 76 and inner cabinet 77. Compartment wall 79 separates the interior of the refrigerator's main cabinet 75 into upper and lower spaces. The upper space forms freezer compartment 70 and the lower space forms refrigeration compartment 71. Blower 73 forcefully delivers cold air chilled by evaporator 72 in a refrigeration cycle provided on the back wall of freezer compartment 70 in a manner to circulate through freezer compartment 70 and refrigerator compartment 71.

Ice-making device 74 disposed inside freezer compartment 70 comprises drive unit 85 having built-in motor (not shown in the figure), reduction gear (not shown) and the like, ice-making vessel 87 having support shaft 86 connected to its center part, frame 88 for turnably supporting ice-making vessel 87 to drive unit 85, and so on.

Frame 88 is provided with stopper 89 at one part of it to deform the shape of ice-making vessel 87 in order to release ice cubes. In addition, ice-making vessel 87 has flange 90 in a position to strike against stopper 89.

There is ice storage box 81 disposed underneath ice-making device 74. Water tank 82 for storing supply of water for ice making is removably placed in one section of refrigerator compartment 71. Water tank 82 has valve 84 to open and close water supply port 83.

Water reservoir 95 is located under water supply port 83 of water tank 82. When water tank 82 is placed with water supply port 83 downward, valve 84 is pushed up to open water supply port 83. Water pump 96 pumps up the water received in water reservoir 95. Water-supply pipe 97 connected to water pump 96 is disposed to open its outlet in ice-making vessel 87 of ice-making device 74.

This conventional ice-making device 74 operates in a manner as described hereinafter. When the user fills water tank 82 with water and places it in a given position, valve 84 is pushed up to open water supply port 83 and deliver the water to fill water reservoir 95. The delivered water is then pumped up by water pump 96, and supplied into ice-making vessel 87 through water pipe 97. The water of a predetermined amount thus supplied in ice-making vessel 87 is frozen by the refrigerating function inside freezer compartment 70 to form ice cubes.

Upon completion of ice making, a turning motion of drive unit 85 causes ice-making vessel 87 to turn upside down around support shaft 86 until flange 90 strikes upon stopper 89. Ice-making vessel 87 is thereby twisted and deformed to release the ice cubes into ice-making vessel 87. The released ice cubes fall in storage box 81 and they are stored therein. After the ice cubes are released, ice-making vessel 87 is returned again to the original position by a reversed turning motion of drive unit 85.

The automatic ice making and storage is continued thereafter by repeating the above operation until the water in water tank 82 is used up completely.

On the other hand, there are a number of methods that determine shapes of produced ice cubes, one of which is to use an ice-making vessel of certain shape as described in the above example of the prior art, and another one is to make a comparatively large block of plank-shaped ice and to crack it into pieces. An example of the latter method is disclosed in Japanese Patent Unexamined Publication, No. H08-86548.

Description is provided hereinafter of the above ice-cracking device of the prior art, by referring to the accompanying drawings.

FIG. 28 is a partially sectioned side view of such conventional ice-cracking device, and FIG. 29 is a longitudinally-sectioned side view of the same conventional ice-cracking device. Box-shaped frame 148 has a recessed portion 149 in the top plate, where feed opening 150 is formed for feeding a block of ice "H". Cover 150A closes feed opening 150. The interior of frame 148 is divided into upper and lower sections by bulkhead 152 having discharge opening 151 for discharging cracked pieces of ice "K". Container 153 for storing the cracked ice "K" is secured below discharge opening 151.

At one side of container 153 facing front opening 154, U-shaped stopper 156 is held to container 153 with pin 157 in a freely rotatable manner so that it normally stays in abutment against the back of door 155 attached to frame 148, and follows the opening and closing motions of door 155. Ice-cracking unit case 159 formed integrally with hopper 158 is secured above discharge opening 151, and hopper 158 is capable of taking a block of ice "H" having a mass of about 4 kg generally used for commercial purpose.

Upper opening 160 of hopper 158 is arranged in communication to feed opening 150.

Ice-cracking unit case 159 is provided therein with two rotors 161 and 162 mounted to shafts 163 and 164 with a predetermined distance in a freely rotatable manner, as shown in FIG. 29. Both of rotors 161 and 162 are provided with two or three arms 165 and 166 in a protruding manner at regular intervals along the axial direction thereof according to cracking sizes of ice, and first smashing pins 167 and 168 are mounted to these arms 165 and 166 respectively. Rotors 161 and 162 are also provided with two or three arms 169 and 170 at regular intervals in the same protruding manner along the axial direction, but at an angle of 180 degrees from first smashing pins 167 and 168. Arms 169 and 170 also have second smashing pins 171 and 172 mounted respectively thereto. There is provided a ridge-shaped pedestal for supporting the block of ice "H" to be cracked by first smashing pins 167 and 168 and second smashing pins 171 and 172 one after another.

The pedestal has a number of arc-shaped grooves 174 formed in areas where the tips of the smashing pins are allowed to travel through.

Ends of shafts 163 and 164 at one side of both rotors 161 and 162 are extended outside of ice-cracking unit case 159, and connected with their respective timing gears 175 and 176 in a manner that first smashing pin 167 of rotor 161 is shifted at a 90-degree angle from another first smashing pin 168 of rotor 162, as shown in FIG. 28. Shaft 164 of rotor 162 is also connected with sprocket wheel 177 which is then engaged by chain 179 to another sprocket wheel 178 fixed to a main shaft of motor M mounted to the exterior sidewall of hopper 158.

In ice-cracking device constructed as above, when a block of ice "H" is thrown in hopper 158, rotors 161 and 162 rotate, and first and second smashing pins 167, 168, 171 and 172 on rotors 161 and 162 alternately strike the block of ice "H" to crack it gradually from its leading end.

In the above structure of the conventional ice-making device, however, cubes of ice it produces have same shape at all times since a configuration of the ice-making vessel determines the shape of ice cubes. In addition, the ice cubes need to be so shaped that side faces are sloped and edges are rounded in order to release the ice cubes from the ice-making vessel by twisting it at the end of ice making. It is for this reason that the device could provide only ice cubes of undesirable shape in appearance for use in beverages such as whiskey and water.

On the other hand, the ice-making device may be equipped with an ice-cracking device to provide ice cubes of desirable shape in appearance, but this requires a conveyer unit for transferring blocks of ice from an ice-making unit through the hopper to the rotors in order for the conventional ice-cracking device to break the ice into pieces.

There was also a drawback that the ice-making device becomes quite bulky in size since the rotors must have dimensions enough to hold a block of plank-shaped ice, and the ice-making unit and the conveyer unit need respectively large capacities to carry the block of ice. Furthermore, it requires a comparatively large motor in order to deliver a large torque sufficient to break the block of ice, and this was also the factor of making the ice-making device so large.

The present invention addresses the above problems of the prior art, and to provide an ice-making device of small size, yet capable of making irregularly-shaped chips of ice not having excessively sloped side faces and rounded edges, which are desirable in appearance for use in such beverages as whiskey and water,

SUMMARY OF THE INVENTION

An ice-making device of the present invention comprises an ice-making unit for making a plank-shaped block of ice, cracking means for cracking the plank-shaped block of ice produced in the ice-making unit into a plurality of ice chips within the ice-making unit, a drive unit for driving the cracking means, and a water supply unit for supplying water to the ice-making unit. The device can thus crack the plank-shaped block of ice to make sharp-cut chips of ice rather than round-edge cubes.

BRIEF DESCRIPTION OF THE DRAWINGS

FIG. 26 is an overall structure of an ice-making device in a conventional refrigerator.

FIG. 27 is a structural illustration of an ice-making unit of the conventional ice-making device.

FIG. 28 is a partially sectioned side view of a conventional ice-cracking device.

FIG. 29 is a longitudinally sectioned side view of the conventional ice-cracking device.

DETAILED DESCRIPTION OF PREFERRED EMBODIMENTS

Figure 1:
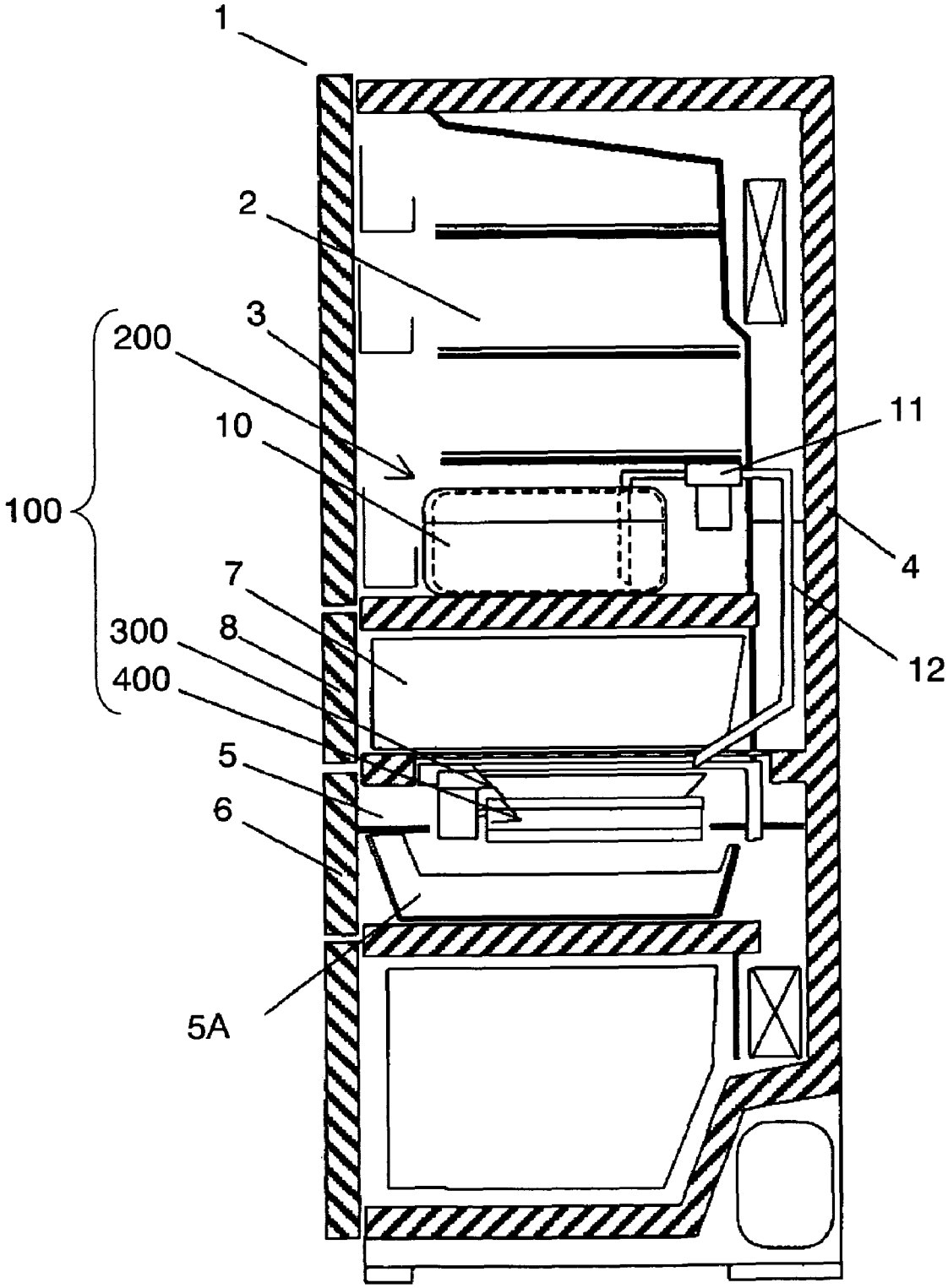
FIG. 1 is a sectional side view of a refrigerator equipped with an ice-making device according to a first exemplary embodiment of the present invention.
Figure 2:
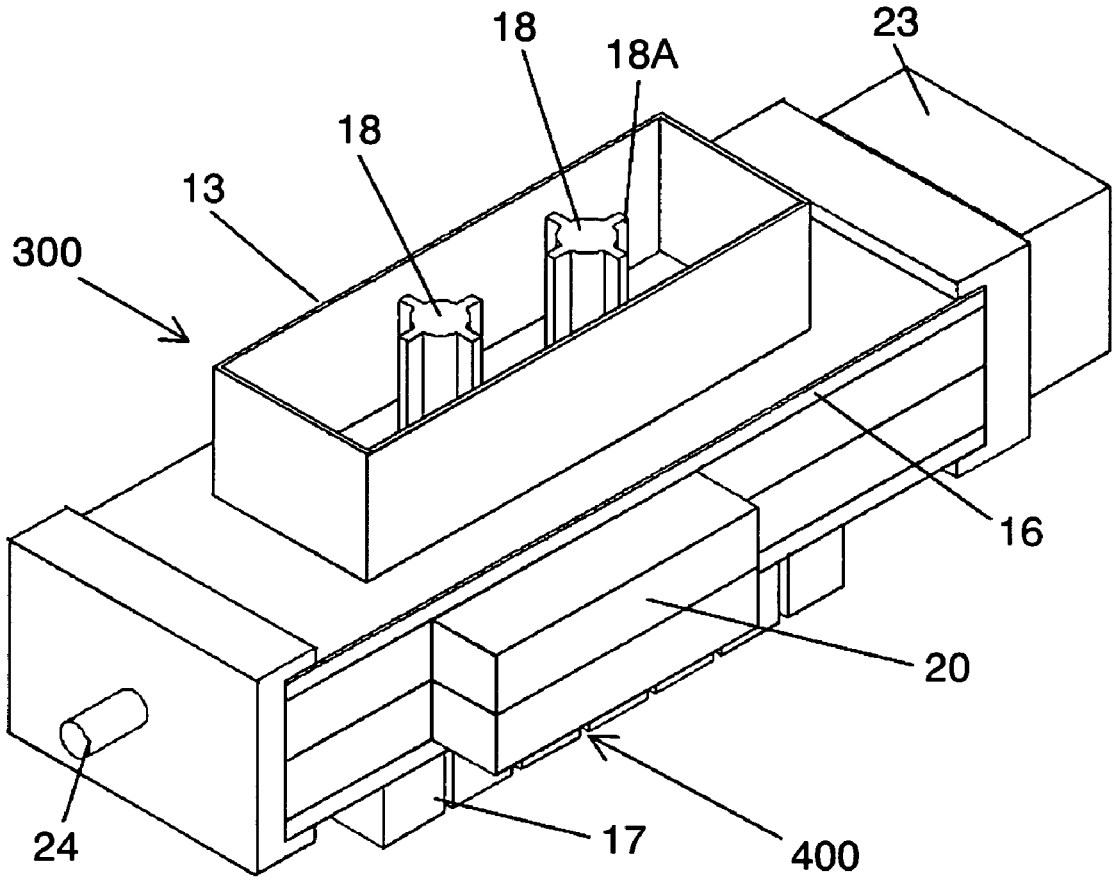
FIG. 2 is a perspective view of the ice-making device according to the first exemplary embodiment of this invention.
Figure 3:
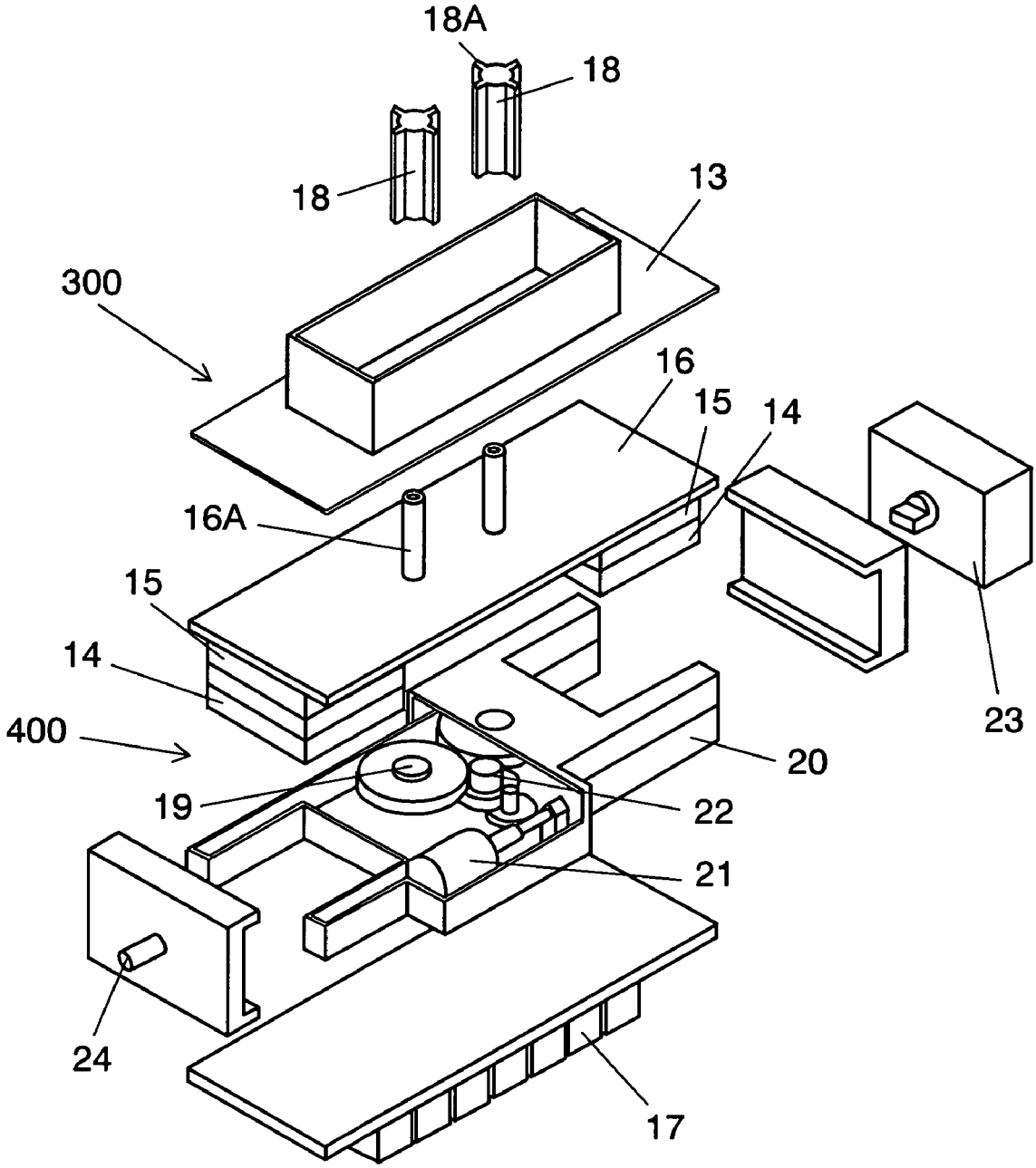
FIG. 3 is an exploded view of the ice-making device according to the first exemplary embodiment of this invention.
Figure 4:
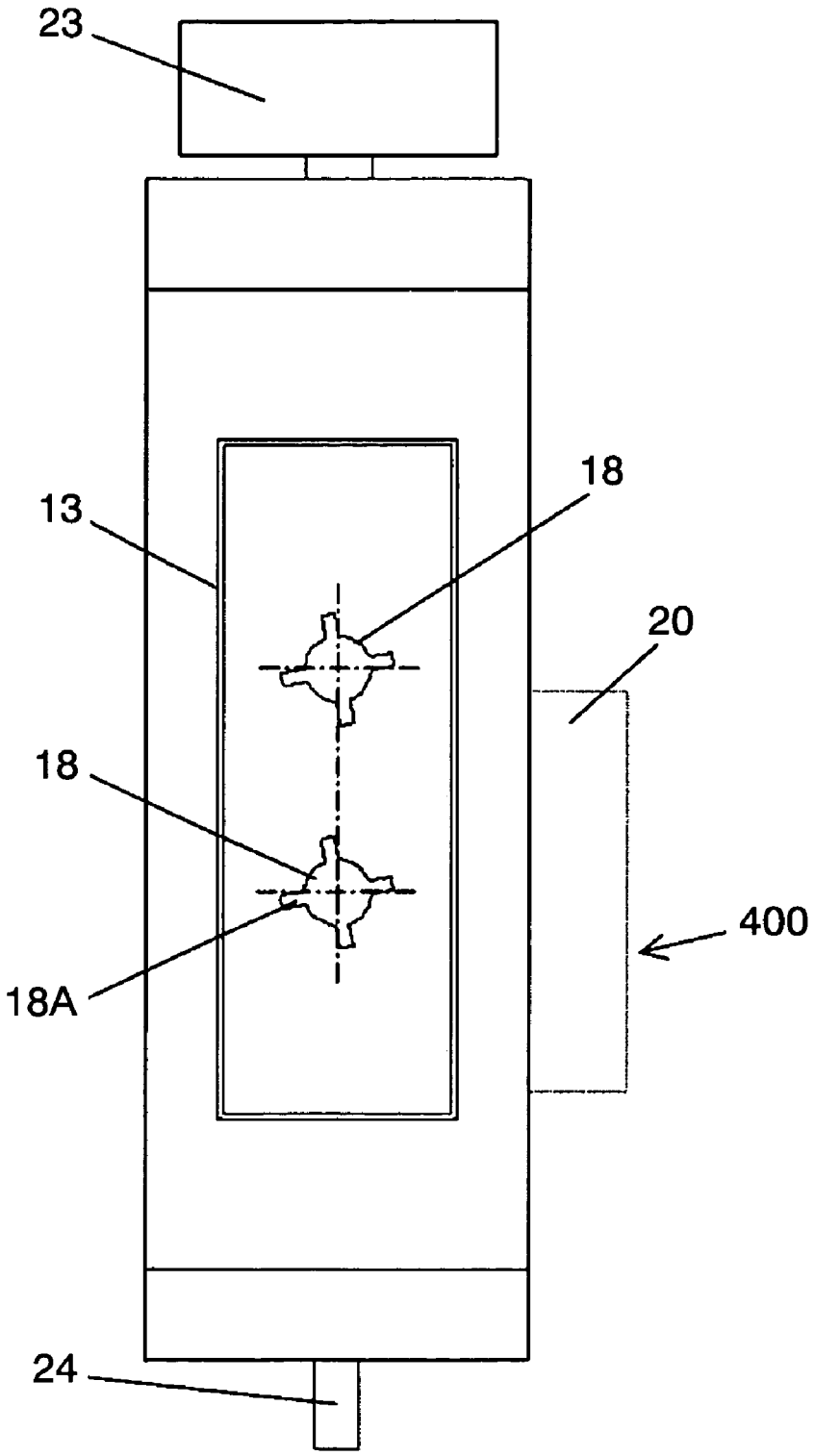
FIG. 4 is a top view of the ice-making device according to the first exemplary embodiment of this invention.

Referring to the accompanying drawings, description will be provided hereinafter of certain examples of the preferred embodiments according to the present invention. Like reference numerals will be used throughout to designate like components as those of the prior art structures, and details of them will be skipped. The preferred embodiments described herein should be considered as illustrative, and therefore not restrictive of the scope of this invention. A refrigeration promoting member used in this invention is cooled directly by chilled air in a range of freezing temperatures for the purpose of expediting cooling of a cooling plate, and it is composed of a material having good thermal conductivity such as aluminum. This refrigeration promoting member may be additionally provided with a plurality of fin-like vanes on its plate base. The structure of such configuration can increase a surface area exposed to the chilled air, thereby improving a cooling effect of the refrigeration promoting member.

First Exemplary Embodiment

Referring now to FIG. 1 through FIG. 4, description is provided of the first exemplary embodiment.

Refrigerator/freezer's main cabinet 1 (hereinafter referred to as main cabinet 1) has a plurality of storage compartments, of which first refrigerator compartment 2 formed in the upper part of it is enclosed and thermally insulated from the external air by door 3 and insulation wall 4. Freezer compartment 5 (hereinafter referred to as ice-making compartment 5) formed under first refrigerator compartment 2 is enclosed and thermally insulated from the external air by insulation wall 4 and door 6. Ice storage box 5A for storing ice cubes is disposed to the lower space of ice-making compartment 5. Second refrigerator compartment 7 located between first refrigerator compartment 2 and ice-making compartment 5 is enclosed and thermally insulated from the external air by insulation wall 4 and door 8. First refrigerator compartment 2 and second refrigerator compartment 7 are connected through an air path for passage of chilled air.

Ice-making device 100 comprises water supply unit 200, ice-making unit 300, and ice-cracking unit 400. Water supply unit 200 comprises water tank 10 placed in first refrigerator compartment 2, water pump 11, and water supply path 12 disposed in a manner to penetrate from first refrigerator compartment 2 to ice-making compartment 5 through insulation wall 4. Ice-making unit 300 comprises ice-making vessel 13 having an open top and open bottom for temporarily storing water and making a plank-shaped hexahedral block of ice, cooling plate 16 fixed to ice-making vessel 13 in a manner that one side surface comes into close contact to and composes a bottom wall of ice-making vessel 13 and the other side surface is in close contact to one surface of Peltier device 14 via heat conduction member 15, and heat sink 17 bonded to the other surface of Peltier device 14.

In addition, cooling plate 16 is provided with two cylindrical posts 16A having openings in both top and bottom and a height generally equal to that of ice-making vessel 13. These cylindrical posts 16A are mounted perpendicularly to cooling plate 16 toward the open top side of ice-making vessel 13 in such positions that divide a longitudinal length of ice-making vessel 13 into three generally equal parts along a line near the center of the short sides. Ice-cracking unit 400 used as a cracking means comprises two shafts 18, each having an outer shell covering each of cylindrical posts 16A mounted to cooling plate 16 and a driving axle penetrating cooling plate 16 through a hole in cylindrical post 16A, and gear unit 20 provided with driving shafts 19 connected to the respective driving axles of two shafts 18.

Each of shafts 18 has four ribs 18A protruding in a radial direction of the rotating axis from the outer shell at generally 90-degree angles with respect to one another to such an extent that they do not interfere with other ribs 18A of adjacent shaft 18 or come in contact to the side walls of ice-making vessel 13. Gear unit 20 reduces a speed of motor 21 by a plurality of reduction gears 22 and the like, and rotates driving shafts 19 simultaneously in the same direction. Gear unit 20 is fixed to ice-making unit 300 in a position between cooling plate 16 and heat sink 17 in a manner to become integral with ice-making unit 300.

In addition, ice-making unit 300 and ice-cracking unit 400 are disposed in a rotatable manner by means of driving mechanism 23 and driving shaft 24, which are for turning ice-making unit 300 and ice-cracking unit 400. Ice-making vessel 13 is placed under a discharge port of water supply path 12 at the upper space inside ice-making compartment 5. Ice-making vessel 13 is thus located above ice storage box 5A in a manner that a periphery of it is buried partly in insulation wall 4 between ice-making compartment 5 and the second refrigerator compartment 7.

Ice-making device 100 constructed as above operates in a manner which is described next. Water pump 11 is driven only for a predetermined number of times of a given duration at predetermined intervals to intermittently supply only a predetermined amount of water in water tank 10 to ice-making vessel 13 through water supply path 12.

Cooling plate 16 located in the bottom surface of ice-making vessel 13 is cooled by Peltier device 14 through heat conduction member 15, and converts water inside ice-making vessel 13 from the liquid phase to solid phase, when Peltier device 14 is supplied with a DC current of a predetermined direction. Heat from Peltier device 14 is dissipated by the chilled air in ice-making compartment 5 during this period since a heat-generating surface of Peltier device 14 is fixed to heat sink 17.

According to this structure, a temperature of cooling plate 16 can be regulated by controlling the current supplied to Peltier device 14, which can hence control a freezing speed.

In this exemplary embodiment, a driving time of water pump 11 is so adjusted that it supplies the water of an amount that rises 0.5 mm in water level in ice-making vessel 13 at each operation for a total number of 40 operations. A temperature surrounding ice-making vessel 13 is influenced by the temperature of second refrigerator compartment 7, and it is usually higher when compared to that of a space around ice storage box 5A located under the ice-making unit which is maintained in the range of freezing temperatures. However, the temperature surrounding ice-making vessel 13 is regulated to approximately 0 deg-C., when necessary, with a heater (not shown) disposed inside insulation wall 4 above ice-making vessel 13 between second refrigerator compartment 7 and ice-making compartment 5. This can help the ice to develop only from the bottom surface. In addition, an amount of the current supplied to Peltier device 14 is so adjusted as to maintain cooling plate 16 to such a temperature that makes the freezing speed constant to bring the supplied water into frozen in a two-hour duration.

Moreover, the driving time intervals of water pump 11 are so adjusted that it starts supplying subsequent amount of water before water of the previous supply becomes completely frozen. In addition, driving mechanism 23 repeats an operating cycle in which ice-making unit 300 and ice-cracking unit 400 are turned and tilted to a predetermined angle, kept still in the tilted position for a given time, and tilt them again to the opposite direction. In the instance of this exemplary embodiment, ice-making vessel 13 is tilted to a 15-degree angle in one direction, and it is kept in this tilted position for 5 seconds before being tilted to the other direction, and this cycle is repeated until the ice making is completed.

Completion of the ice making is determined when a temperature detected by a temperature sensor (not shown) mounted to ice-making vessel 13 becomes lower than a predetermined temperature after an elapse of a predetermined time following the given operating cycles of water pump 11.

Upon completion of the ice making, a current of the reverse direction is supplied to Peltier device 14 for a predetermined duration to remove the ice off the bottom of cooling plate 16. Following the above, motor 21 on gear unit 20 of the ice-cracking unit is energized for a predetermined time period to rotate two shafts 18 simultaneously only to a certain angle by way of reduction gears 22, driving shaft and the like. The rotation of shafts 18 imposes a turning force to the ice block while the ice block is restricted from making such turning movement by the side walls of ice-making vessel 13. This results in concentration of stresses given in the ice by ribs 18A of shafts 18, which in turn produces outward cracks in the ice from around shafts 18, and cracks the plank-shaped block of ice into a plurality of irregularly-shaped chips without round edges.

When the ice is completely cracked, driving mechanism 23 turns ice-making unit 300 and ice-cracking unit 400 upside down, and the chips of ice fall as they are into ice storage box 5A because they are separated from ice-making vessel 13 when cracked into pieces.

In ice-making device 100 of this exemplary embodiment, as described above, the water is supplied intermittently to maintain a thin layer of unfrozen state of water at all the time, while the water is gradually frozen upward from the bottom of ice-making vessel 13 of ice-making unit 300. This helps the air dissolved in the water to form air bubbles and diffuse into the surrounding air, and thereby this device can produce ice of high clarity.

In addition, this device repeats the motion of tilting and stopping ice-making vessel 13 while making ice, which moves a boundary surface between the ice and water, separates air bubbles formed on the boundary surface by the flow of water, and facilitates the air bubbles to diffuse into the air around ice-making vessel 13 by their own buoyancy. Accordingly, this device can produce the highly clear ice in a comparatively fast speed.

In ice-cracking unit 400 used as cracking means of the plank-shaped ice, a torque required for shafts 18 to crack the ice differs depending on thickness and shape of the ice. The torque necessary for each of the shafts is approximately 2 to 6 Nm in the case of ice having a thickness of about 20 mm used in this exemplary embodiment. In other words, it is a torque that can be obtained easily with any ordinary DC motor, so as to realize a compact ice-cracking unit of small size at low cost. This ice-making device can thus provide highly clear ice chips of varied shapes with no rounded edge, and sensually excellent for use in beverages such as whiskey and water. The cracks are likely to develop in the directions of rotation of the tips of ribs 18A as well as the directions extending linearly along the line between two axes of rotation of shafts 18. It is therefore feasible to control how cracks are made in the ice to some extent. It is also possible to reduce an amount of finely crushed ice fragments by arranging the protruding direction of one of four ribs 18A on one shaft 18 in alignment linearly with another one of four ribs 18A on the adjoining shaft 18.

As illustrated in this exemplary embodiment, simultaneous rotation of two shafts 18 having four ribs 18A can crack the block of ice into generally six pieces.

Numbers of shafts 18 or ribs 18A may be increased if desired to increase the number of cracked pieces from the plank-shaped block of ice.

On the other hand, the plurality of shafts 18 needs not be rotate at the same time to crack the ice. However, it is desirable to rotate the plurality of shafts 18 simultaneously in order crack the ice properly with the simple structure of this ice-making unit, since the ice should be secured to avoid rotation with any of shafts 18.

The block of ice can be cracked by rotating shafts 18 even when the bottom of ice block remains stuck on the cooling plate. However, it is more desirable to rotate shafts 18 after loosening the ice block from the cooling plate, because it is more likely to produce finely crushed ice fragments if the cracking motion is initiated before loosening the ice from the cooling plate.

It is also feasible to crack the block of ice by heating shafts 18 and piercing them into the ice block gradually while melting the ice only after the ice block is completed, and shafts 18 rotated after the ice block is refrozen again. However, this operation requires two motions of shafts 18, a vertical motion and a rotary motion, which makes more complex the structure of gear unit 20 for driving shafts 18. Although this structure can still achieve ice-cracking unit 400 of a size smaller than the conventional ice-cracking unit, it is desirable to set shafts 18 inside the space of ice block in advance in order to further reduce the overall size of ice-making device 100.

In this exemplary embodiment, hollow cylindrical posts 16A are mounted perpendicularly upward from the bottom surface of ice-making unit 300 to the height generally equal to that of ice-making vessel 13, and shafts 18 are inserted to cover them in order that the open top ends of posts 16A are kept not lower than a surface of the water supplied into ice-making vessel 13.

As a result, this structure can improve reliability of preventing leakage of water (i.e., sealing) since shafts 18 are not inserted directly through the bottom surface of ice-making vessel 13 where water is supplied.

The structure also facilitate removal and replacement of shafts 18 of different rib configuration as well as any other parts, when necessary to adjust them according to different thickness of ice blocks or shapes of cracked ice chips, since shafts 18 are simply inserted to cover cylindrical posts 16A.

In this exemplary embodiment, however, cylindrical posts 16A are not necessarily used as stated above. Instead, shafts 18 may be inserted directly through the bottom surface of ice-making vessel 13 if a suitable design is taken into account for the sealing structure around insertion holes in the bottom surface of ice-making vessel 13. When such a structure is adopted, the height of shafts 18 protruding in ice-making vessel 13 needs not necessarily be higher than the water surface, but shafts 18 can be inserted to any depth to yield the optimum effect of ice cracking.

Because the shafts in this exemplary embodiment are designed to have the height enough to protrude above the upper surface of ice block, the ice-cracking force of the shafts is imparted to the entire area from the bottom surface to the upper surface of ice block, thereby making it easy to control how the ice block is cracked.

In this exemplary embodiment, although ice-making device 100 was illustrated as being mounted to the interior of main cabinet 1, it is not intended to limit the scope of this invention to the above structure. Ice-making device 100 may be provided on itself with a cooling device for cooling the exterior area thereof for use as a small ice-making device.

Second Exemplary Embodiment

Figure 5:
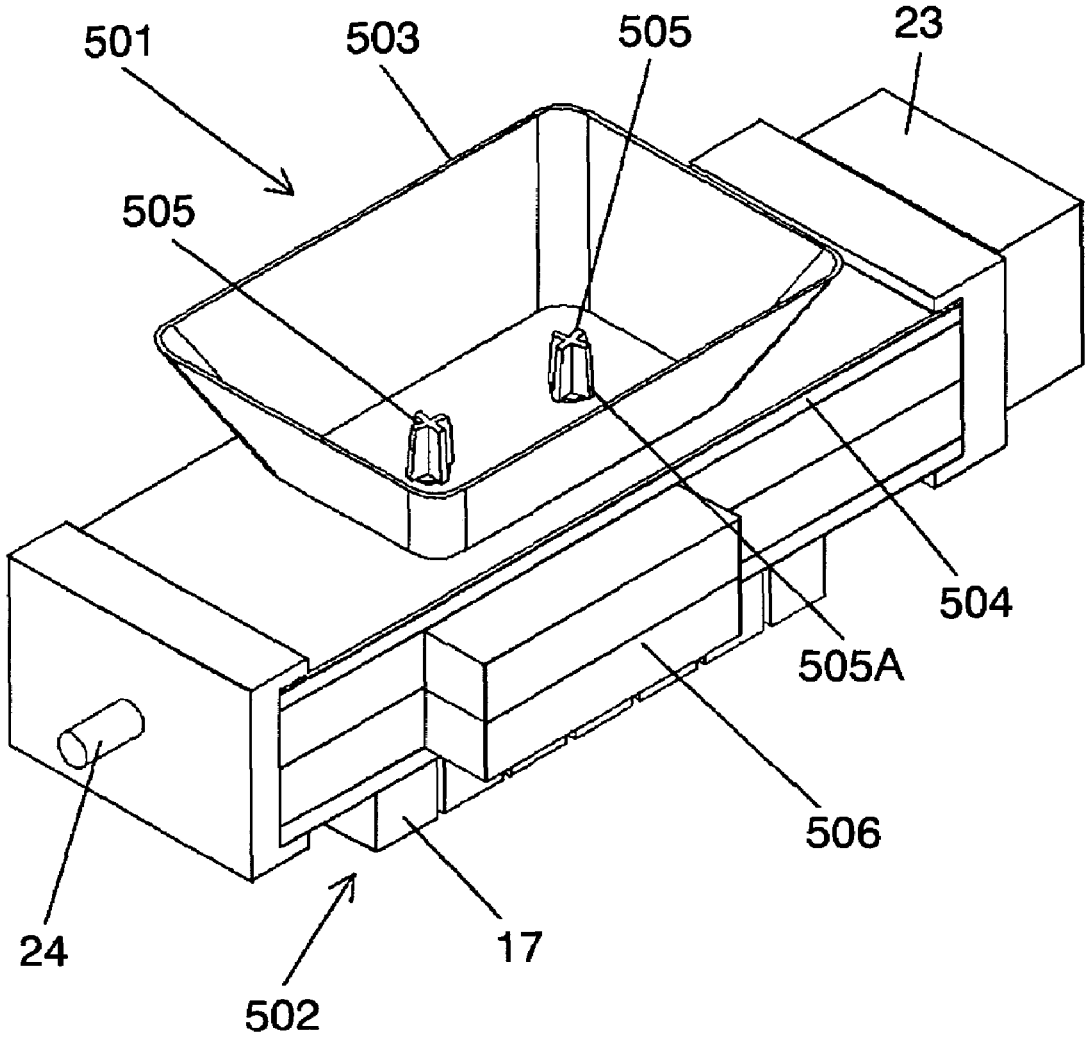
FIG. 5 is a perspective view of an ice-making unit and an ice-cracking unit of an ice-making device according to a second exemplary embodiment of this invention.
Figure 6:
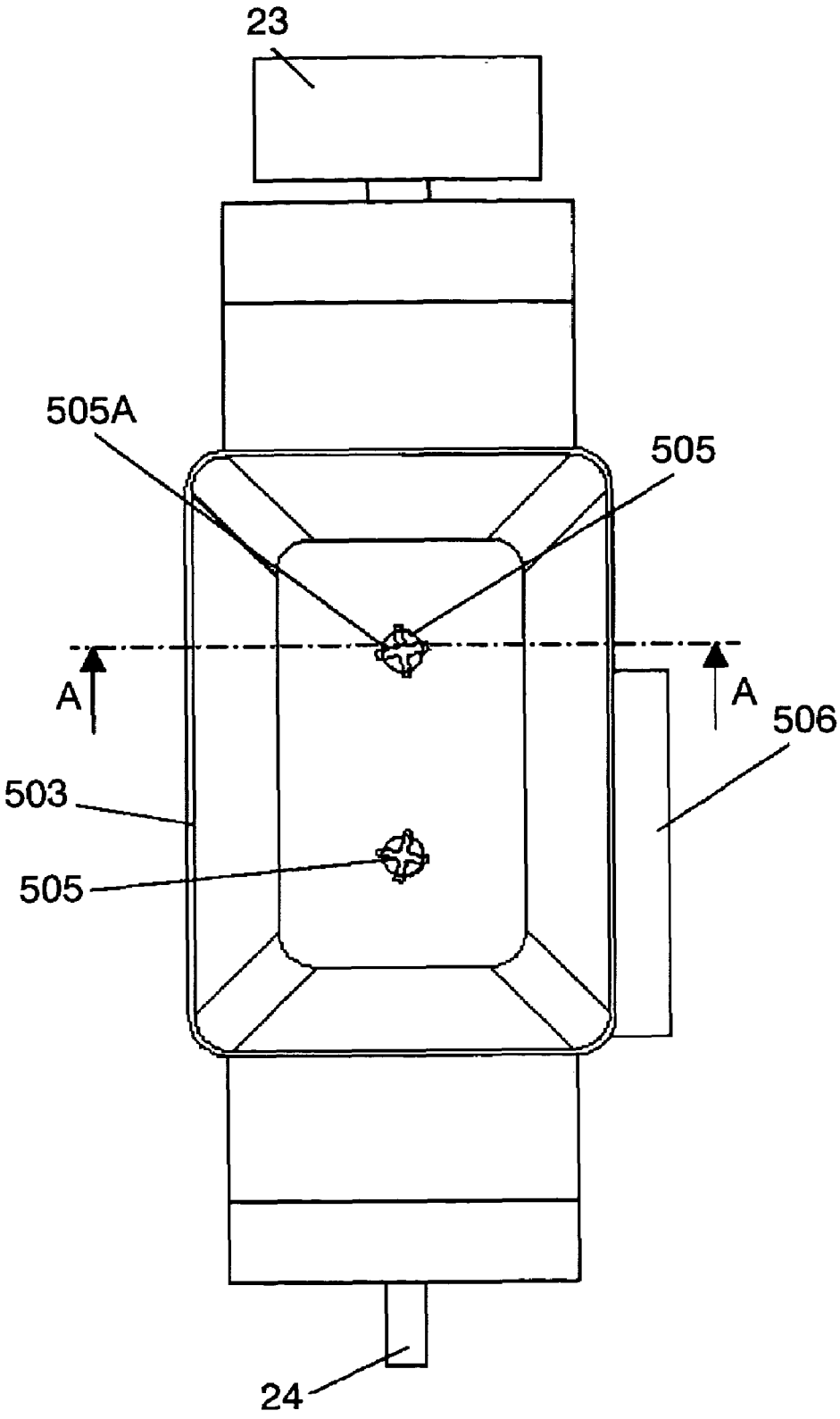
FIG. 6 is a top view of the ice-making device according to the second exemplary embodiment of this invention.
Figure 7:
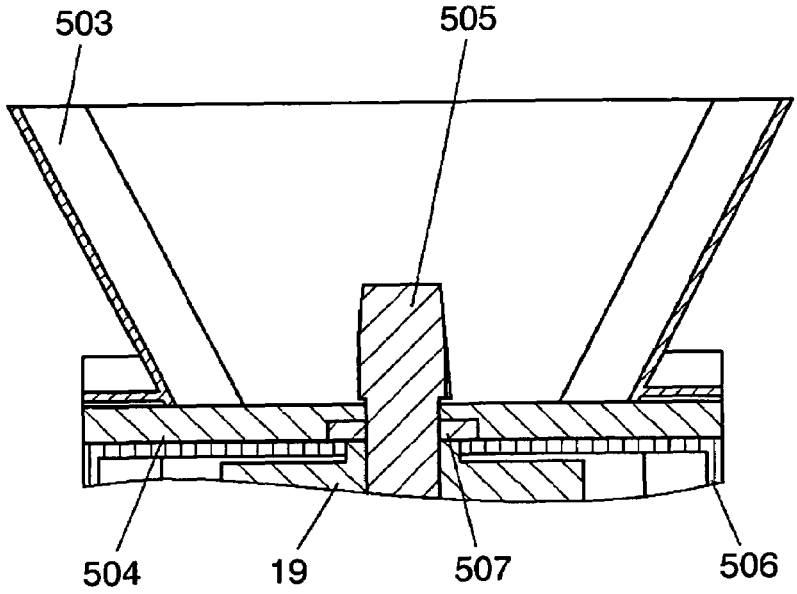
FIG. 7 is a sectional view taken along the line A-A of the ice-making device according to the second exemplary embodiment of this invention.
Figure 8:
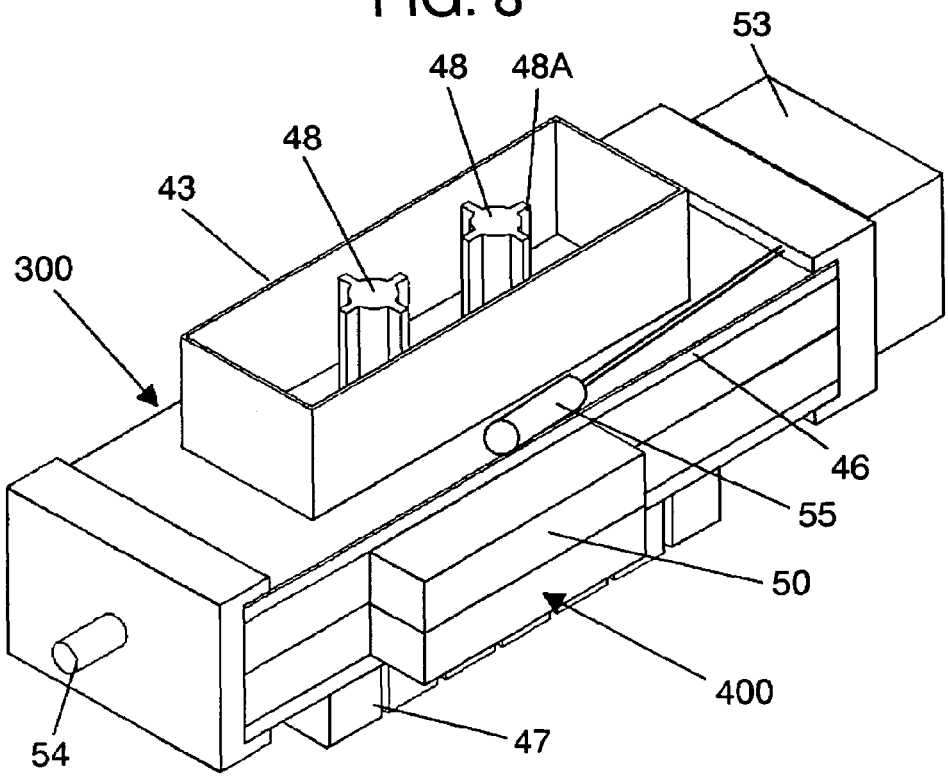
FIG. 8 is a perspective view of a part of ice-making device according to a third exemplary embodiment of this invention.
Figure 9:
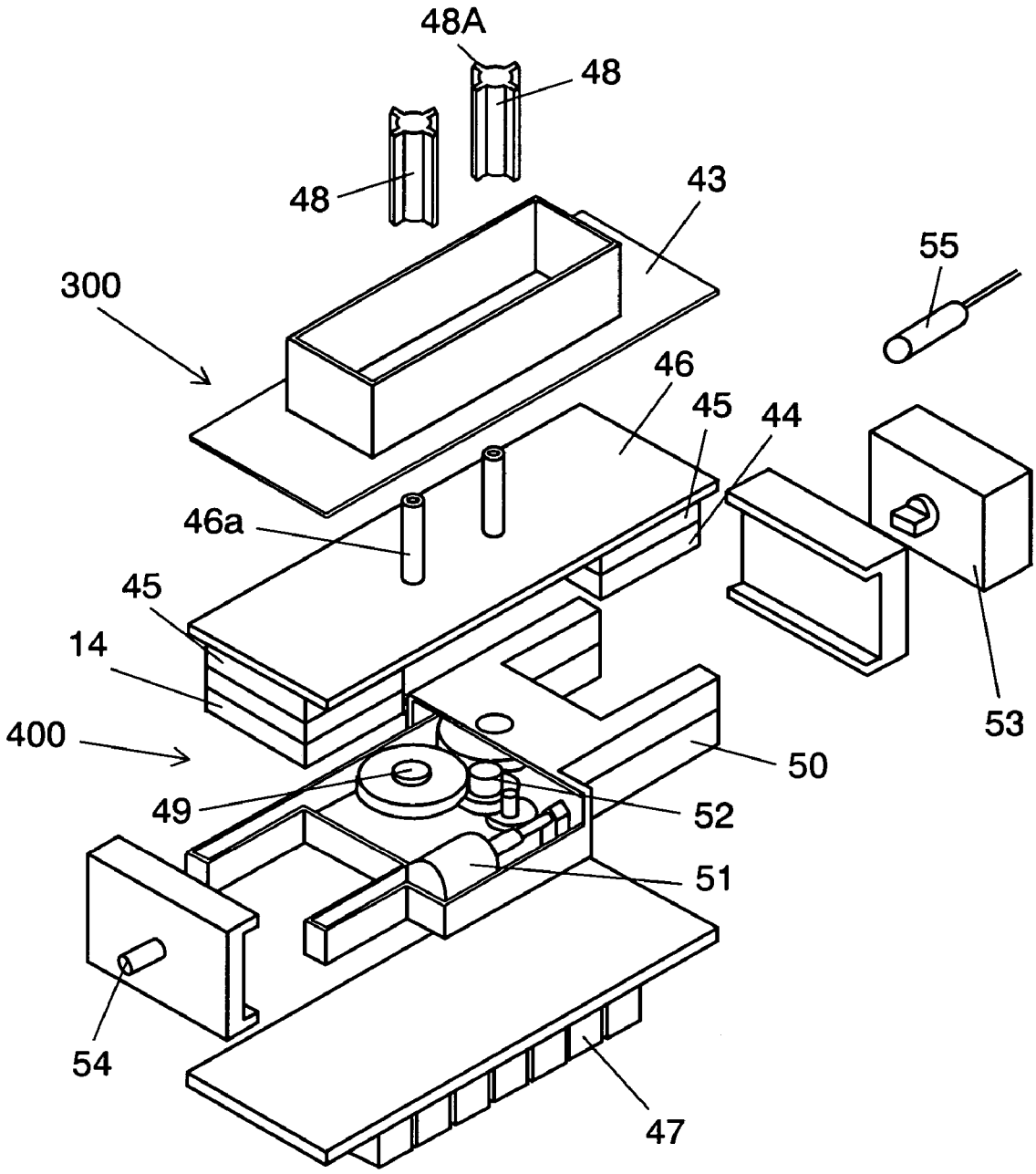
FIG. 9 is an exploded view of the ice-making device according to the third exemplary embodiment of this invention.

Description is provided of an ice-making device of the second exemplary embodiment with reference to FIG. 5 through FIG. 7.

Like reference numerals are used to designate like components as those of the first exemplary embodiment, and details of them will be skipped.

Ice-making device 100 comprises water supply unit 200, ice-making unit 501, and ice-cracking unit 502 for use as ice-cracking means Ice-making unit 501 comprises ice-making vessel 503 having an open top and open bottom with side surfaces sloped in a direction to make the top opening larger in area than an area of the bottom opening, for temporarily storing water and making a plank-shaped block of ice, cooling plate 504 fixed to ice-making vessel 503 in a manner that one side surface comes into close contact to and composes a bottom wall of ice-making vessel 503 and the other side surface is in close contact to one surface of Peltier device 14 via heat conduction member 15, and heat sink 17 bonded to the other surface of Peltier device 14. Ice-cracking unit 502 comprises two shafts 505 inserted through two holes bored in cooling plate 504, and gear unit 506 provided with driving shafts 19 connected to their respective shafts 505. There are sealing members 507 formed of nitrile rubber or the like material attached from the side facing gear unit 506 to the inserting spaces of cooling plate 504 and shafts 505, and sealing members 507 are coated with grease on their surfaces in contact with shafts 505. As a result, there is hardly any chance of water in the ice-making unit to leak into the space of gear unit 506.

An upper portion of each shaft 505 extending above cooling plate 504 has four ribs 505A formed in a manner to protrude in a radial direction of the rotating axis of shaft 505 at generally 90-degree angles with respect to one another to such an extent that they do not interfere with other ribs 505A of adjacent shaft 505 or come in contact to the side walls of ice-making vessel 503, and that protruding length of ribs 505A is longer at the lower side of shaft 505 near cooling plate 504 than the upper end facing the top opening of ice-making vessel 503. Shafts 505 is formed to have a height smaller than the height of ice block made inside ice-making vessel 503.

Gear unit 506 reduces a speed of motor 21 by a plurality of reduction gears 506A and the like, and rotates driving shafts 19 simultaneously in different directions to each other.

Two shafts 505 are so disposed that one of four ribs 505A is generally in alignment linearly with one of four ribs 505A of the adjoining shaft 505, as well as a line drawn in phantom between the end of the rib at the side of the rotating direction and the center of rotation.

Ice-making unit 501 and ice-cracking unit 502 are fixed integrally in a rotatable manner with driving mechanism 23 and driving shaft 24.

Description is provided hereinafter of an operation after the ice-making, in ice-making device 100 serving as the main device constructed as above according to the present invention.

Upon completion of the ice making, gear unit 506 is driven to turn two shafts 505 at the same time, which breaks a plank-shaped block of ice formed in ice-making vessel 503, and the broken ice chips fall into the ice storage box when ice-making unit 501 is reversed together with ice-cracking unit 502 by driving mechanism 23.

In ice-making device 100 of this exemplary embodiment, a turning force is imposed on the ice when shafts 18 are driven, as stated above. However, such turning movement of the ice is restricted due to rotating directions of the two shafts which are opposite to each other, and concentration of stresses imparted to the ice block around the ends of ribs 505A causes the ice to crack apart.

Once the ice block is cracked, the cracked pieces of ice are freely movable along the side walls of ice-making vessel 503 even if shafts 505 rotate continuously because the side walls of ice-making vessel 503 are sloped. Therefore, gear unit 506 does not require a large torque to drive shafts 505 after the ice block is cracked.

This structure produces different patterns of cracks in the ice block along the vertical direction of ice-making vessel 503, because ribs 505A are so formed that the protruding length is longer at the side near cooling plate 504 than the upper end facing the top opening of ice-making vessel 503. That is, this configuration can crack the ice block into more irregular shapes.

If ice block is made with shafts 505 designed to extend beyond the water surface, the ice is frozen with convexed surface in the vicinities of shafts 505 as compared to the other areas due to the surface tension of water. When shafts 505 are rotated to crack the ice block under such condition, parts of the ice around the convexed areas get stuck on shafts 505, and they occasionally remain stuck even after the ice-making unit is turned upside down to discharge the cracked ice. Measures need to be taken in this case in order to positively release the ice pieces, such that shafts 505, are rotated for several times after the ice block is cracked to loosen and disengage the stuck pieces. In the structure of this exemplary embodiment, on the other hand, the height of shafts 505 is so fixed that it is smaller than the height of the ice block formed inside ice-making vessel 503, so as to make the ice having a nearly flat surface in the end. Accordingly, this structure ensures complete release of the cracked ice pieces since no ice gets stuck on shafts 505 to disturb falling pieces of the cracked ice.

When the function of the shafts can be met with a small angle of rotation, the gears serving for the driving shafts in the gear unit need to be formed of only certain angles instead of forming the entire 360-degree angle, and this can further reduce the size of the gear unit.

The shafts may be made of a metallic material having a high resistance to corrosion with sufficient strength such as stainless steel in order to prolong a useful life of the ice-cracking unit, and to make it free from maintenance.

Alternatively, the shafts may be made of a plastic material having a high rigidness such as polyacetal, which can reduce the cost of the shafts because of the excellent mouldability.

Third Exemplary Embodiment

Description is provided of ice-making device 100 of the third exemplary embodiment with reference to FIG. 1 and FIG. 8 through FIG. 10. Like reference numerals are used to designate like components as those of the first exemplary embodiment, and details of them will be skipped.

Refrigerator/freezer's main cabinet 1 (hereinafter referred to as main cabinet 1) has a plurality of storage compartments, and first refrigerator compartment 2 formed in the upper part of it is enclosed and thermally insulated from the external air by door 3 and insulation wall 4. Freezer compartment 5 (hereinafter referred to as ice-making compartment 5) formed under first refrigerator compartment 2 is enclosed and thermally insulated from the external air by insulation wall 4 and door 6. Ice storage box 5A for storing ice chips is disposed to the lower space of ice-making compartment 5. Second refrigerator compartment 7 located between first refrigerator compartment 2 and ice-making compartment 5 is enclosed and thermally insulated from the external air by insulation wall 4 and door 8. First refrigerator compartment 2 and second refrigerator compartment 7 are connected through an air path for passage of chilled air.

Ice-making device 100 comprises water supply unit 200, ice-making unit 300, and ice-cracking unit 400. Water supply unit 200 comprises water tank 10 placed in first refrigerator compartment 2, water pump 11, and water supply path 12 disposed in a manner to penetrate from first refrigerator compartment 2 to ice-making compartment 5 through insulation wall 4. Ice-making unit 300 comprises ice-making vessel 43 having an open top and open bottom for temporarily storing water and making a plank-shaped hexahedral block of ice, cooling plate 46 fixed to ice-making vessel 43 in a manner that one side surface comes into close contact to and composes a bottom wall of ice-making vessel 43 and the other side surface is in close contact to one surface of Peltier device 14 via heat conduction member 45, and heat sink 47 bonded to the other surface of Peltier device 14.

In addition, cooling plate 46 is provided with two cylindrical posts 46A having openings in both top and bottom and a height generally equal to that of ice-making vessel 43. These cylindrical posts 46A are mounted perpendicularly to cooling plate 46 toward the open top side of ice-making vessel 43 in such positions that divide a longitudinal length of ice-making vessel 43 into three generally equal parts along a line near the center of the short sides. Ice-cracking unit 400 comprises two shafts 48, each having an outer shell covering each of cylindrical posts 46A mounted to cooling plate 46 and a driving axle penetrating cooling plate 46 through a hole in cylindrical post 46A, and drive unit 50 (hereinafter referred to as gear unit) provided with driving shafts 49 connected to the respective driving axles of two shafts 48. Shafts 48 function as cracking means which are rotatory driven inside ice-making unit 300 for cracking a plank-shaped block of ice into chips. Each of shafts 48 has four ribs 48A protruding in a radial direction of the rotating axis from the outer shell at generally 90-degree angles with respect to one another to such an extent that they do not interfere with other ribs 48A of the adjacent shaft 48 or come in contact to the side walls of ice-making vessel 43. Gear unit 50 reduces a speed of motor 51 by a plurality of reduction gears 52 and the like, and rotates driving shafts 49 simultaneously in the same direction. Gear unit 50 is fixed to ice-making unit 300 in a position between cooling plate 46 and heat sink 47 in a manner to become integral with ice-making unit 300.

In addition, ice-making unit 300 and ice-cracking unit 400 are disposed in a rotatable manner by means of driving mechanism 53 and driving shaft 54, which are for turning ice-making unit 300 and ice-cracking unit 400. Ice-making vessel 43 is placed under a discharge port of water supply path 12 at the upper space inside ice-making compartment 5. Ice-making vessel 43 is thus located above ice storage box 5A in a manner that a periphery of it is buried partly in insulation wall 4 between ice-making compartment 5 and the second refrigerator compartment 7.

Temperature sensor 55 is disposed in the vicinity of ice-making vessel 43 on cooling plate 46 for detecting a state of water inside ice-making vessel 43. Temperature sensor 55 is thermally insulated except for a surface that is in contact with cooling plate 46. A thermistor is one example of such components used for temperature sensor 55.

Ice-making device 100 is controlled by a control unit (not shown).

Ice-making device 100 constructed as above operates in a manner which is described next.

Figure 10:
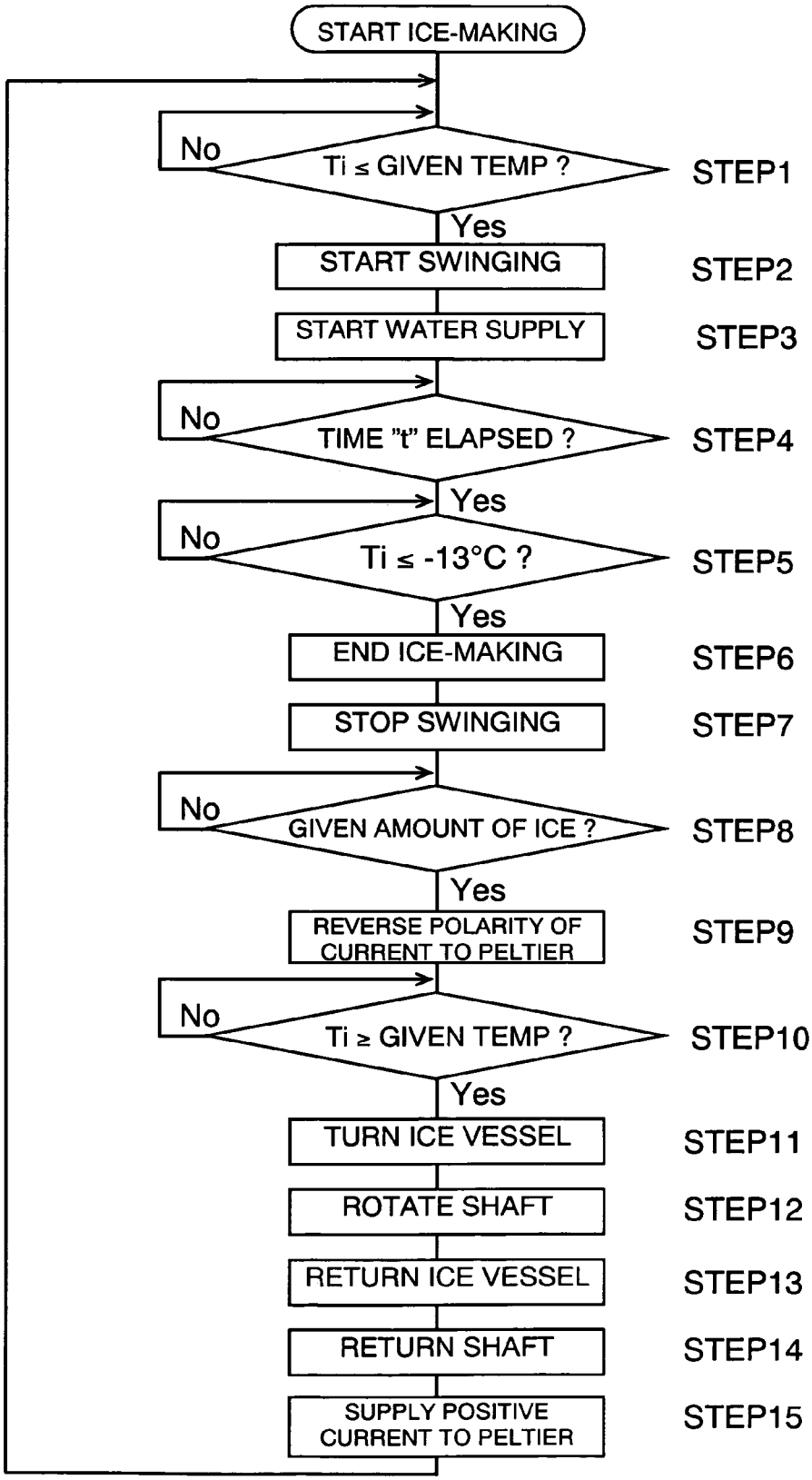
FIG. 10 is a flow chart showing a main part of control operation performed by a control unit according to the third exemplary embodiment of this invention.

FIG. 10 is a flow chart showing a main part among a number of control operations of ice-making device 100 performed by the control unit according to this invention. When an ice-making control begins and temperature sensor 55 detects a temperature below a predetermined value (STEP 1), driving mechanism 53 starts swinging operation for repeating a cycle consisting of turning ice-making unit 300 and ice-cracking unit 400 to a predetermined degree of tilting angle, holding them at the tilted angle for a predetermined time, and turning them in the opposite direction (STEP 2). In this exemplary embodiment, ice-making vessel 43 is tilted to 15 degrees in one direction, and again tilted to 15 degrees in the opposite direction after holding it at the tilted position for 5 seconds, and this cycle is repeated until the ice-making process ends.

Water pump 11 is driven only for a predetermined number of times of a given duration at predetermined intervals to intermittently supply only a predetermined amount of water in water tank 10 to ice-making vessel 43 through water supply path 12 (STEP 3).

Cooling plate 46 located in the bottom surface of ice-making vessel 43 is cooled by Peltier device 14 through heat conduction member 45, and converts water inside ice-making vessel 43 from the liquid phase to solid phase, when Peltier device 14 is supplied with a DC current of a predetermined direction (hereinafter referred to as a positive current). Heat from Peltier device 14 is dissipated by the chilled air in ice-making compartment 5 during this period since a heat-generating surface of Peltier device 14 is fixed to heat sink 47. According to this structure, a cooling capacity of cooling plate 46 can be regulated by controlling the current supplied to Peltier device 14, which can hence control a freezing speed.

In this exemplary embodiment, a driving time of water pump 11 is so adjusted that it supplies the water of an amount that rises 0.5 mm in water level inside ice-making vessel 43 at each operation for a total number of 20 water-supply operations. A temperature surrounding ice-making vessel 43 is influenced by the temperature of second refrigerator compartment 37, and it usually remains at a comparatively high temperature. However, the temperature surrounding ice-making vessel 43 is regulated to approximately 0 deg-C., when necessary, with a heater (not shown) disposed inside insulation wall 4 above ice-making vessel 43 between second refrigerator compartment 7 and ice-making compartment 5. This can help the ice to develop only from the bottom surface. In addition, an amount of the current supplied to Peltier device 14 is so adjusted as to maintain cooling plate 46 to such a temperature that makes the freezing speed constant to bring the supplied water into frozen in a two-hour duration.

Moreover, the driving time intervals of water pump 11 are so adjusted that it starts supplying subsequent amount of water before water of the previous supply becomes completely frozen.

A driving interval of water pump 11 is adjusted in a manner so that it supplies the subsequent amount of water before the previously supplied water becomes completely frozen.

When a predetermined time duration "t" has elapsed after water pump 11 has operated for the predetermined number of times (STEP 4), temperature sensor 55 disposed to ice-making vessel 43 checks whether temperature Ti being monitored becomes below a predetermined temperature (STEP 5), and determines completion of the ice-making operation (STEP 6). The swinging operation is ended upon completion of the ice-making operation (STEP 7). When an amount of ice in ice storage box 15A is detected to be less than a predetermined amount (STEP 8), a current of the opposite direction is supplied to Peltier device 14 (STEP 9) to raise the temperature monitored by temperature sensor 55 to a level higher than the predetermined temperature (STEP 10). The problem of ice getting stuck on cooling plate 46 is thus dissolved by melting the ice slightly in this manner.

Driving mechanism 53 is operated thereafter to turn ice-making unit 300 and ice-cracking unit 400 upside down (STEP 11), and to rotate two shafts 48 simultaneously only by a predetermined angle by means of gear unit 50 of ice-cracking unit 400 (STEP 12).

When shafts 48 are rotated, there occurs a turning force imposed on the ice block in a way to rotate with shafts 48. Since the side walls of ice-making vessel 43 restrict such a turning movement of the ice block, the turning force produces concentration of stresses imparted to the ice block via ribs 48A of shafts 48, which in turn produces cracks in the ice block from around shafts 48 toward outer walls of ice-making vessel 43, and cracks the plank-shaped block of ice into a plurality of irregularly-shaped chips without round edges. The cracked chips of ice thus fall as they are into ice storage box 15A.

When shafts 48 end their rotary motion, driving mechanism 53 returns ice-making unit 300 and ice-cracking unit 400 into the original horizontal position (STEP 13), and gear unit 50 brings shafts 48 into the original positions (i.e., starting points) (STEP 14). During this operation, shafts 48 can be returned to their original positions by rotating them in a direction opposite the direction where they are rotated when the ice block is cracked. In this exemplary embodiment, however, shafts 48 are rotated past their starting positions at once, and rotated again in the direction of cracking the ice block before stopping at the starting positions.

Or, after the rotation (in STEP 12), shafts 48 may be driven again for a predetermined time (e.g., 5 seconds), and so arranged thereafter that their positions become starting positions designated in advance. Afterwards, ice-making unit 300 is returned to the horizontal position.

Following the above steps, a positive current is supplied to Peltier device 44 (STEP 15), and the operation returns to the start of ice-making control (STEP 1).

In ice-making device 100 of this third exemplary embodiment, as described above, the plank-shaped block of ice positively falls into the ice storage box as soon as it is cracked, because the ice-making unit is positioned upside down when the block of ice is being cracked. This ice-making device can thus provide irregularly-shaped pieces of ice without having rounded edges, and sensually excellent for use in beverages such as whiskey and water.

In addition, this structure can reduce to the utmost a time difference among the plurality of shafts to transfer the forces of the shafts to the block of ice attributable to the play of the transmission gears among the shafts, since the shafts are rotated to the direction of cracking the ice before coming to the stop when they are returned to the starting positions. As a result, the plurality of shafts can properly transfer their individual forces to the block of ice to crack it positively.

In this structure, the shafts are rotated for the predetermined time even after the block of ice is cracked. This structure makes good use of the shafts to separate the ice stuck on the ice-making unit, so as to help remove the ice easily.

The structure also takes an advantage of heating the cooling plate before the ice block is cracked to avoid the ice from sticking to it. This feature facilitates cracking of the ice block with a considerably small torque. It can also reduce finely crushed fragments of ice which are not useful.

It also prevents the once frozen ice from being melted and making refreezing necessary, since it does not advance the subsequent steps of heating the cooling plate unless the ice contained in the ice storage box is found to be less than the predetermined amount. This can also ensure the ice storage box to store more amount of ice than necessary.

If the ice storage box contains more ice than the predetermined amount, this device keeps the cooling plate at a temperature below zero to preserve the newly-made ice in the ice-making vessel, so that it can replenish the ice storage box as soon as the ice is consumed to a level below the predetermined amount.

In the process of ice-making according to this exemplary embodiment, the water is gradually frozen upward from the bottom of ice-making vessel 43 of ice-making unit 300. There is also a thin layer of unfrozen state of water maintained at all the time since the water is supplied intermittently. This helps the air dissolved in the water to become air bubbles and diffuse into the surrounding air, and thereby the device can produce ice of high clarity.

In addition, this device repeats the motion of tilting and stopping ice-making vessel 43 while making ice, which continuously moves a boundary surface between the ice and water, separates air bubbles formed on the boundary surface by the flow of water, and facilitates the air bubbles to diffuse into the air around ice-making vessel 43 by their own buoyancy. Accordingly, this device can produce the highly clear ice in a comparatively fast speed.

Once the cracked ice is released, this device restarts the next water-supply operation, but only after heating the ice-making unit to a temperature above the predetermined value. This process can prevent the ice from losing the clarity in the bottom area due to rapid freezing of the supplied water, thereby making ice of even higher clarity.

In ice-cracking unit 400 used for cracking the plank-shaped block of ice, a torque required for shafts 48 to crack the ice can be obtained easily with any ordinary DC motor. This means the compact ice-cracking unit can be realized in a small size at low cost.

Fourth Exemplary Embodiment

Figure 11:
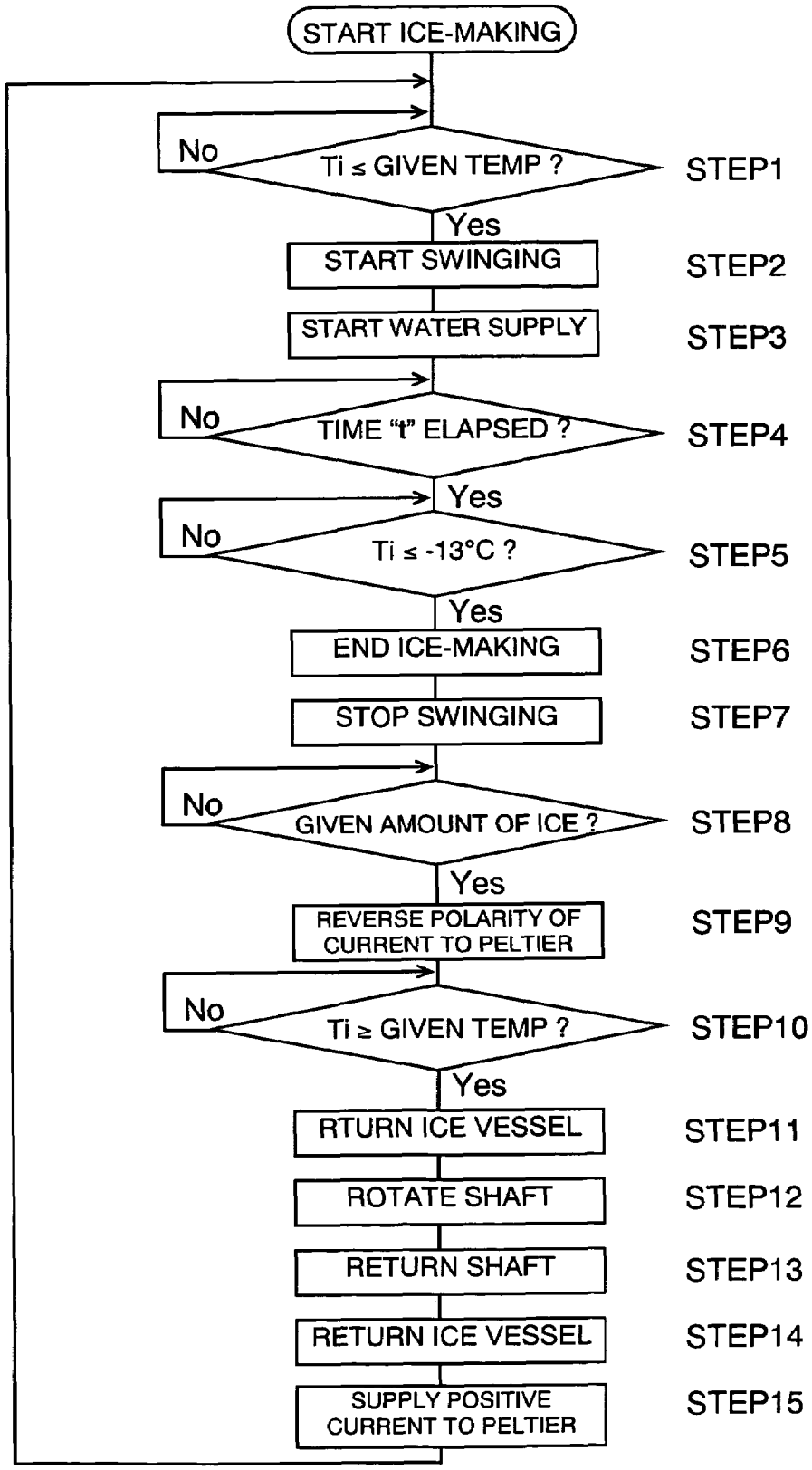
FIG. 11 is a flow chart showing a main part of control operation performed by an ice-making device according to a fourth exemplary embodiment of this invention.

Description is provided of ice-making device 100 of the fourth exemplary embodiment with reference to FIG. 11.

Like reference numerals are used to designate like components as those of the third exemplary embodiment, and details of them will be skipped. FIG. 11 is a flow chart showing a main part among a number of control operations of ice-making device 100 performed by a control unit (not shown) according to this invention.

Description from STEP 1 to STEP 12 will be skipped since they are same processes as those described in the third exemplary embodiment.

When shafts 48 are rotated, there occurs a turning force imposed on a block of ice in a way to rotate with shafts 48. However, the side walls of ice-making vessel 43 restrict such a turning movement of the ice block. This results in concentration of stresses imparted to the ice block via ribs 48A of shafts 48, which in turn produces cracks in the ice block from around shafts 48 toward outer walls of ice-making vessel 43, and cracks the plank-shaped block of ice into a plurality of irregularly-shaped chips without round edges. The cracked chips of ice thus fall as they are into ice storage box 35A.

When the ice block is completely cracked, gear unit 50 returns shafts 48 to the original positions (i.e., starting points) (STEP 13).

During this moment, pieces of ice stuck on shafts 48 and not released into ice storage box 35A are shaken by rotation of shafts 48, and disengaged to fall in the box below.

Afterwards, driving mechanism 53 returns ice-making unit 300 and ice-cracking unit 400 to the horizontal position (STEP 14).

Peltier device 44 is then supplied with a positive current (STEP 15), and the operation returns to the start of ice-making control (STEP 1).

In ice-making device 100 of this fourth exemplary embodiment, as described above, the plank-shaped block of ice positively falls into the ice storage box as soon as it is cracked, because the ice-making unit is positioned upside down when the block of ice is being cracked.

In addition, the device drives the shafts to shake the cracked ice when the shafts are returned to their original positions while the ice-making unit is kept upside down, even if the cracked ice stick to any of the shafts and the ice-making vessel without falling. Since the structure releases the cracked chips of ice from being stuck and allow them to fall more positively in the described manner, it can provide irregularly-shaped chips of ice without having rounded edges, and sensually excellent for use in beverages such as whiskey and water.

Fifth Exemplary Embodiment

Figure 12:
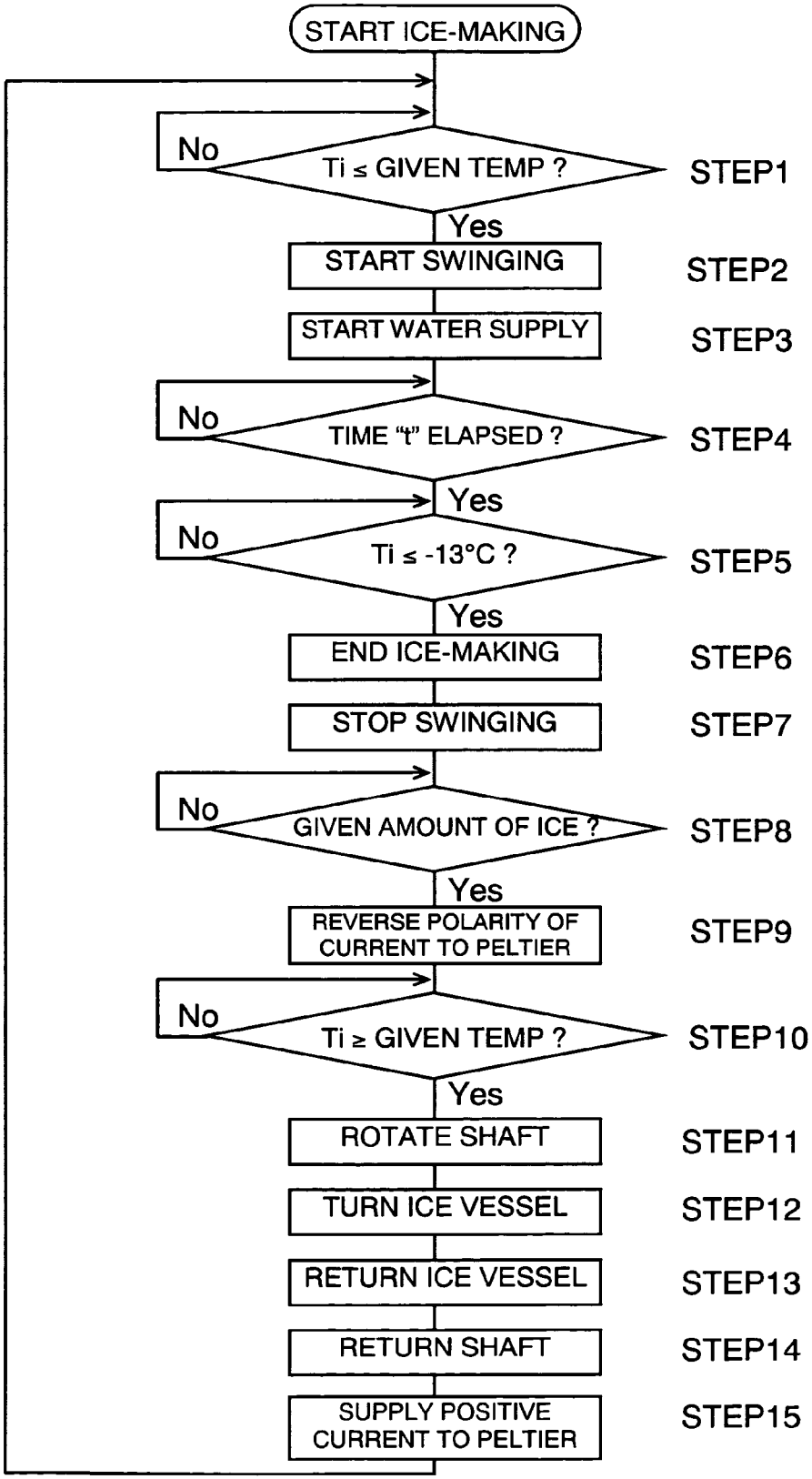
FIG. 12 is a flow chart showing a main part of control operation performed by an ice-making device according to a fifth exemplary embodiment of this invention.

Description is provided of ice-making device 100 of the fifth exemplary embodiment with reference to FIG. 12.

Like reference numerals are used to designate like components as those of the fourth exemplary embodiment, and details of them will be skipped. FIG. 12 is a flow chart showing a main part among a number of control operations of ice-making device 100 performed by a control unit (not shown) according to this invention.

Description from STEP 1 to STEP 10 will be skipped since they are same processes as those described in the fourth exemplary embodiment.

Gear unit 50 drives and rotates two shafts 48 simultaneously up to a predetermined angle (STEP 11). When shafts 48 are rotated, there occurs a turning force imposed on a block of ice in a way to rotate with shafts 48. However, the side walls of ice-making vessel 43 restrict such a turning movement of the ice block, which results in concentration of stresses imparted to the ice block via ribs 48A of shafts 48, which in turn produces cracks in the ice block from around shafts 48 toward outer walls of ice-making vessel 43, and cracks the plank-shaped block of ice into a plurality of irregularly-shaped chips without round edges.

Driving mechanism 53 is operated thereafter to turn ice-making unit 300 and ice-cracking unit 400 upside down (STEP 12). During this operation, the cracked chips of ice fall as they are into ice storage box 35A by their own gravity since they are separated off the walls of ice-making vessel 43 due to the heating and cracking operations.

Gear unit 50 returns shafts 48 to their original positions (i.e., starting points) (STEP 13).

During this moment, pieces of ice stuck on shafts 48 and not released into ice storage box 35A are shaken by rotation of shafts 48, and disengaged to fall in the box below.

Afterwards, driving mechanism 53 returns ice-making unit 300 and ice-cracking unit 400 to the horizontal position (STEP 13), and gear unit 50 also returns shafts 48 to their original positions (i.e., starting points) (STEP 14).

Peltier device 44 is then supplied with a positive current (STEP 15), and the operation returns to the start of ice-making control (STEP 1).

As described above, ice-making device 100 of this fifth exemplary embodiment turns the ice-making unit upside down only after it cracks the block of ice, and thereby it does not cause loud sound, which could occur by ice chips dropping wildly into the ice storage box as they are being cracked. The device can hence provide irregularly-shaped chips of ice without having rounded edges, and sensually excellent for use in beverages such as whiskey and water.

Sixth Exemplary Embodiment

Figure 13:
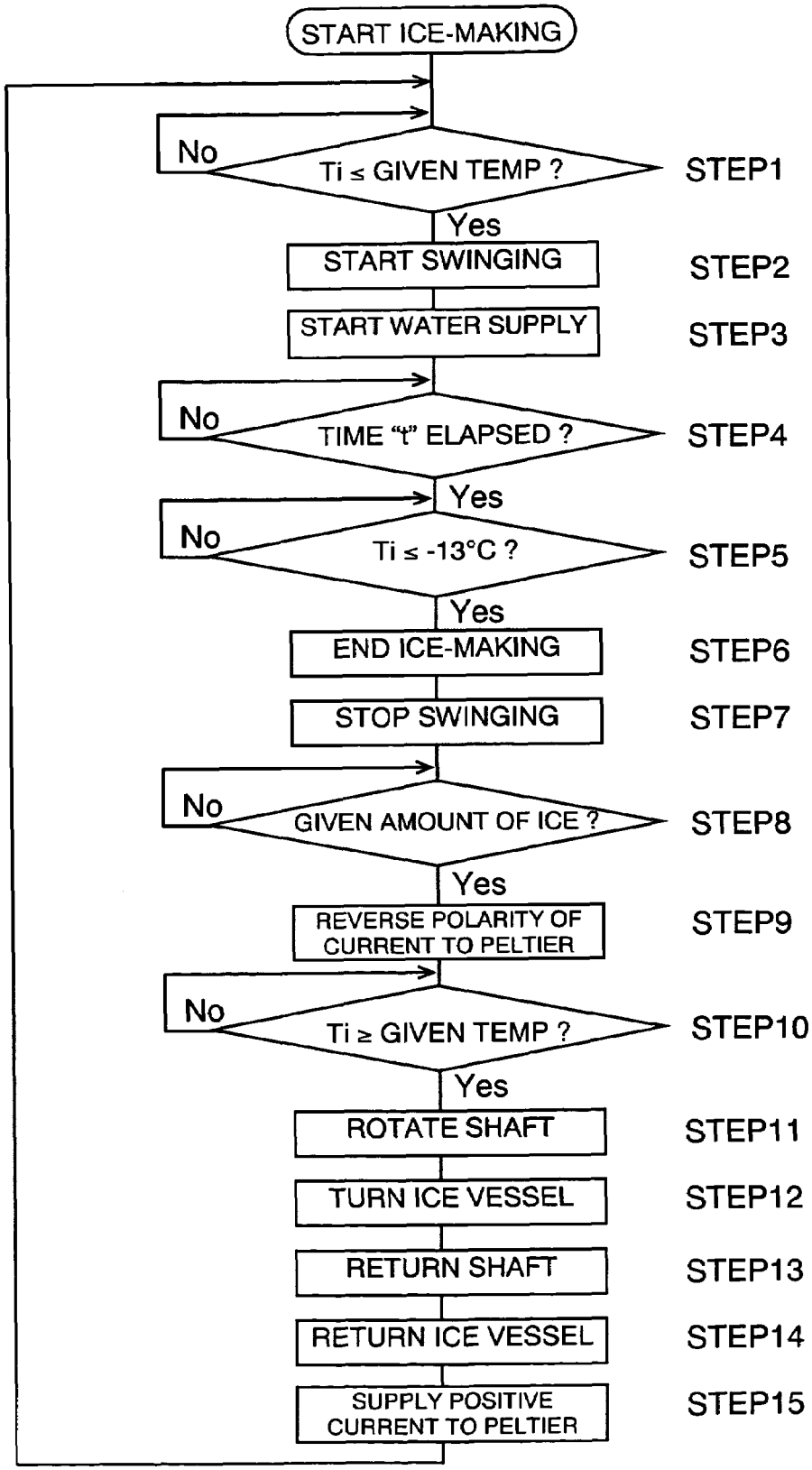
FIG. 13 is a flow chart showing a main part of control operation performed by an ice-making device according to a sixth exemplary embodiment of this invention.

Description is provided of ice-making device 100 of the sixth exemplary embodiment with reference to FIG. 13.

Like reference numerals are used to designate like components as those of the fifth exemplary embodiment, and details of them will be skipped. FIG. 13 is a flow chart showing a main part among a number of control operations of ice-making device 100 performed by a control unit according to this invention. Description from STEP 1 to STEP 12 will be skipped since they are same processes as those described in the fifth exemplary embodiment.

When a turning operation is completed, gear unit 50 returns shafts 48 to their original positions (i.e., starting points) (STEP 13).

During this moment, pieces of ice stuck on shafts 48 and not released into ice storage box 35A are shaken by the rotation of shafts 48, and disengaged to fall in the box below.

Afterwards, driving mechanism 53 returns ice-making unit 300 and ice-cracking unit 400 to the horizontal position (STEP 14).

Peltier device 44 is then supplied with a positive current (STEP 15), and the operation returns to the start of ice-making control (STEP 1).

As described above, ice-making device 100 of this sixth exemplary embodiment turns the ice-making unit upside down only after it cracks the block of ice, and thereby it does not cause loud sound, which could occur by ice chips dropping wildly into the ice storage box as they are being cracked.

Furthermore, since the device returns the shafts to their original positions while the ice-making unit is kept upside down, it shakes the cracked ice by the rotation of the shafts, and thereby it can release the cracked chips of ice from being stuck and allow them to fall more positively. The device can hence provide irregularly-shaped chips of ice without having rounded edges, and sensually excellent for use in beverages such as whiskey and water.

Seventh Exemplary Embodiment

Figure 14:
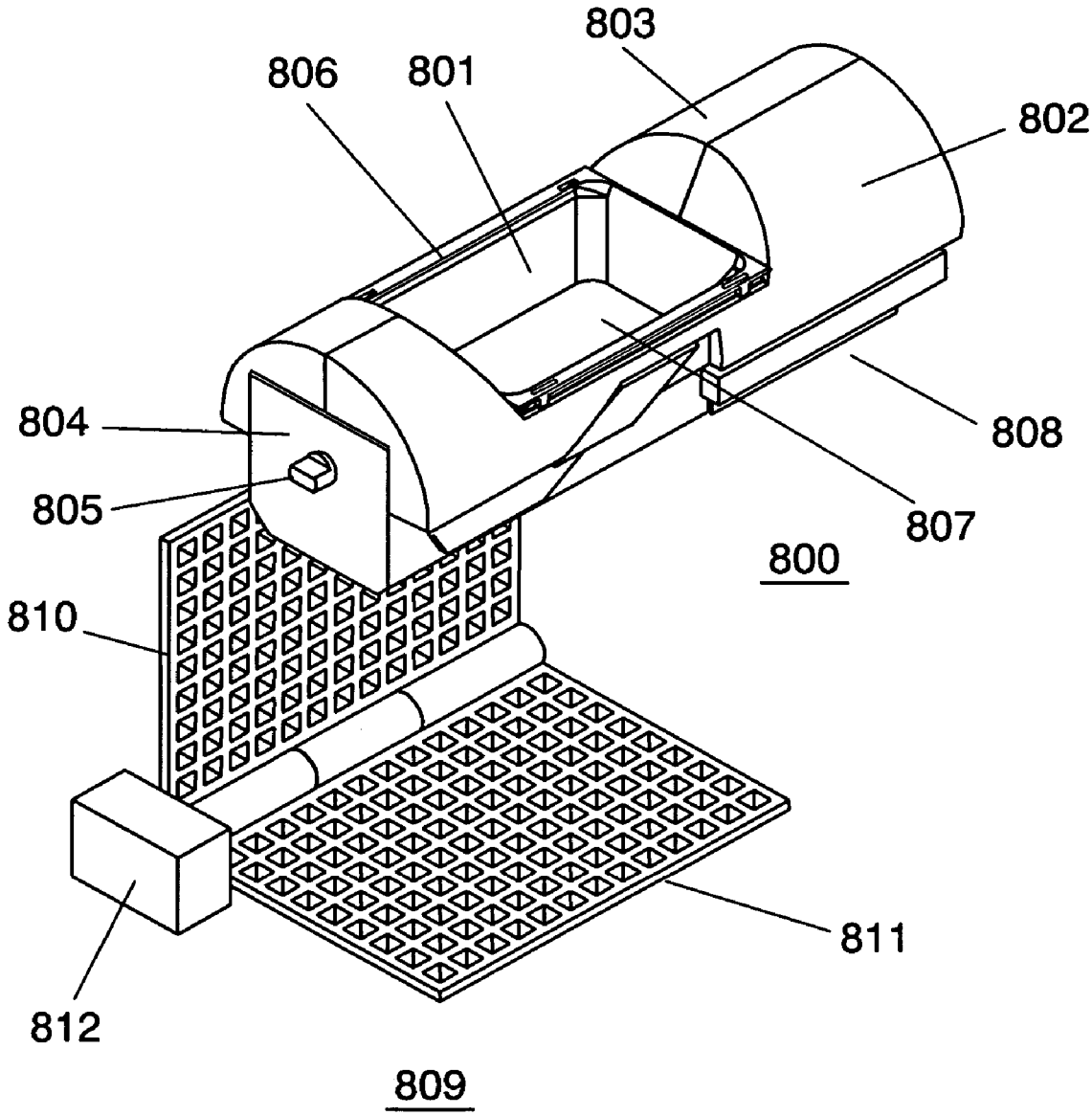
FIG. 14 is a perspective view of an ice-making device according to a seventh exemplary embodiment of this invention.
Figure 15:
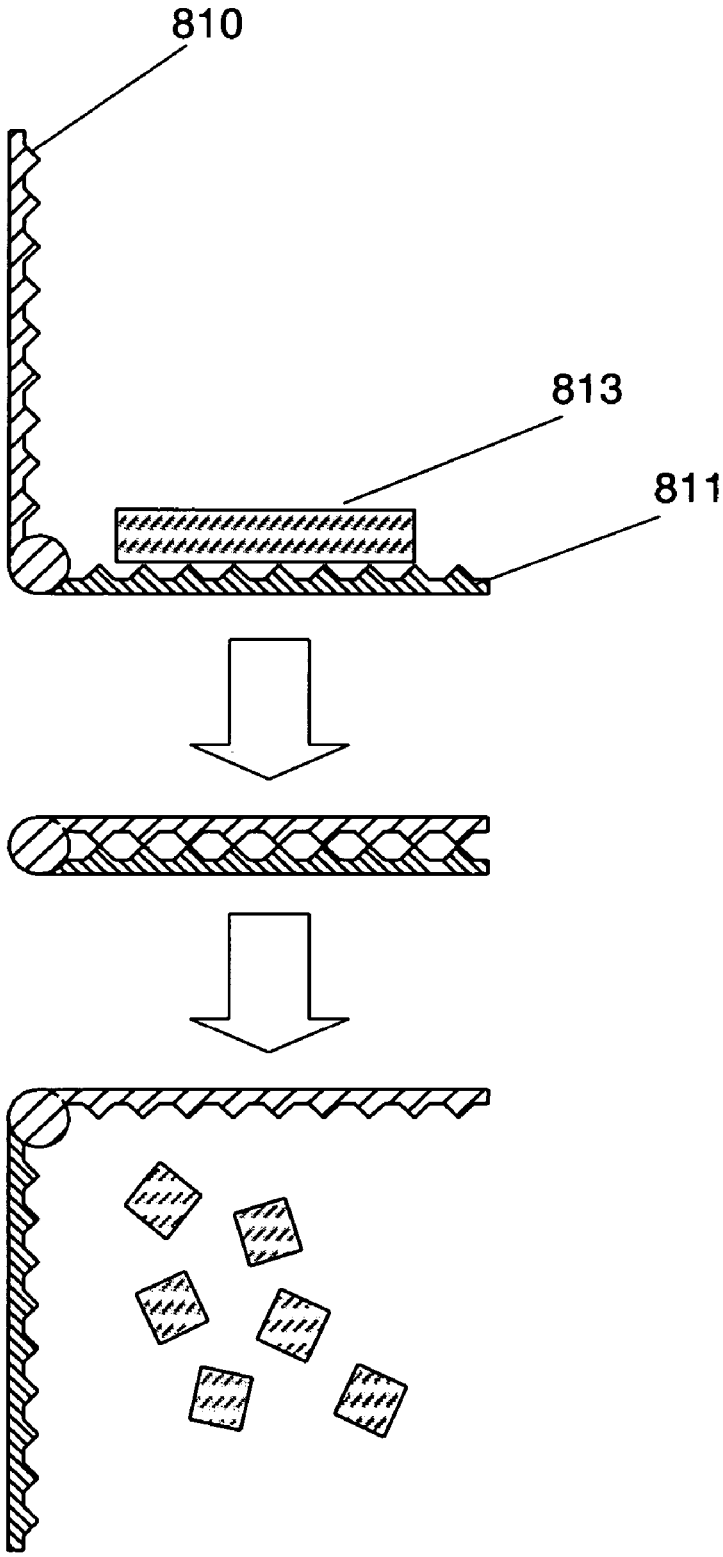
FIG. 15 is a sectional view of a main part of the ice-making device showing an ice-cracking operation according to the seventh exemplary embodiment of this invention.

Description is provided of an ice-making device of the seventh exemplary embodiment with reference to FIG. 14 and FIG. 15.

Ice-making device 800 comprises ice-making unit 801, insulating materials 802 and 803 enclosing ice-making unit 801, and swinging-turning unit 804. Swinging-turning unit 804 is provided with drive shaft 805. Ice-making unit 801 comprises ice-making vessel 806 having an open bottom, and cooling plate 807 for composing a bottom surface of ice-making vessel 806.

Cooling plate 807 is provided with fin-shaped cooling accelerate member 808, and cooling plate 807 and cooling accelerate member 808 are formed integrally.

Ice-cracking unit 809 is disposed underneath ice-making device 800.

Ice-cracking unit 809 comprises ice-cracking plates 810 and 811, and ice-cracker drive unit 812.

The ice-making device constructed as above operates in a manner which is described hereinafter.

Ice-making unit 801 of ice-making device 800 disposed in a freezing atmosphere is supplied with a predetermined amount of water from the above by water supply means. The water supplied in ice-making unit 801 starts being frozen from the lower side by cooling plate 807 and cooling accelerate member 808. There is a heating means (not shown) located above ice-making device 800, and the heating means together with insulating materials 802 and 803 maintain the surrounding space of ice-making unit 801 at a non-freezing temperature of not lower than 0 deg-C.

The operations of these components make ice to grow upward from the lower side, discharge air bubbles inside the water toward the unfrozen water, and eventually release them into the atmosphere above the water surface. Release of the air bubbles is not impeded since the water near the surface is kept from being frozen by the heating means and insulating materials 802 and 803. As a result, the device can produce clear cubes of ice while limiting amount of air bubbles contained in the frozen ice.

Swinging-turning unit 804 is kept operating during the ice-making process for swinging motion of predetermined cycle and swinging angle about drive shaft 805. This motion moderately stirs the water in ice-making unit 801 to promote degassing of the water.

When detection means detects completion of the ice-making, swinging-turning unit 804 turns itself upside down about drive shaft 805 to drop the block of ice from ice-making unit 801. The solid block of ice made in ice-making unit 801 is defined as ice block 813.

Ice-cracking unit 809 disposed under ice-making device 800 has ice-cracking plates 810 and 811 in an open position to an angle of approximately 90 degrees, and ice block 813 falls on ice-cracking plate 811.

Next, ice-cracker drive unit 812 turns, and this motion rotates ice-cracking plate 810 in the closing direction. Ice-cracking plate 811 is kept not rotated during this process so that ice block 813 is pressed between ice-cracking plates 810 and 811, and cracked into dimensions suitable for practical use.

After the ice block 813 is cracked, ice-cracking plate 811 rotates downward to drop the cracked pieces of ice further downward.

Upon completing the series of operations, ice-cracking plates 810 and 811 return to their original positions while maintaining the 90-degree angle, and wait for the next block ice.

Although ice-cracking plates 810 and 811 were described as having the angle of approximately 90 degrees with respect to each other, they may be opened to a 180-degree angle in the vertical orientation or either one of them may be shifted to same phase to the other, so as to allow the ice block to drop directly from the ice-making unit for storage as it is.

In this case, the user can take the ice block of the original size for processing into any size of his choice, by using a commercially available ice crusher or an ice pick, for instance.

As described above, ice-making device 800 of this exemplary embodiment comprises ice-making unit 801, insulating materials 802 and 803, and swinging-turning unit 804. Ice-cracking unit 809 is disposed underneath ice-making device 800, and it comprises ice-cracking plate 810, another ice-cracking plate 811, and ice-cracker drive unit 812. This combination of ice-making device and ice-cracking unit 809 has capability of cracking the block ice into small chips of suitable size while making a block of clear ice simultaneously.

Eighth Exemplary Embodiment

Description is provided of an ice-making device of the eighth exemplary embodiment with reference to FIG. 16 through FIG. 22.

Water pump 11 defining an intermittent water supply means supplies water inside water tank 10 little by little in a plurality of steps to ice-making unit 300 through water supply pipe 11A.

Ice-making unit 300 comprises ice-making vessel 503, cooling plate 16, and water sealing member 30 disposed in a space between outer flange 503B of ice-making vessel 503 and cooling plate 16. There is also provided ice-cracker drive unit 68 under cooling plate 16. Furthermore, heat sink 69 is provided under ice-cracker drive unit 68, and cooling means is placed between cooling plate 16 and heat sink 69. Cooling means comprises one or more units of Peltier device 14, for example. Fixing member 60 is disposed on the periphery of Peltier device 14 for the purpose of securing the position of Peltier device 14. In addition, water-infiltration sealing member 31 is placed in each of spaces between cooling plate 16 and fixing member 60, and heat sink 69 and fixing member 60, to prevent moisture from infiltrating in the vicinity of Peltier devices from the outside. Both cooling plate 16 and heat sink 69 are made of a material of good thermal conductivity such as aluminum. Supporting members 61 and 62 are integrally formed individually with respective one of supporting brackets 63 and 64 having generally a box-like configuration with open end at one side. Ice-making vessel 503, cooling plate 16, water sealing member 30, ice-cracker drive unit 68, heat sink 69, Peltier device 14, fixing member 60 and water-infiltration sealing members 31 are held between top and bottom by supporting brackets 63 and 64.

In this structure, ice-making vessel 503 is pressed in the directions of cooling plate 16 by supporting members 61 and 62, while also imposing a moderate compression on water sealing member 30.

One side of supporting member 62 has insertion opening 32 formed integrally, and a driving shaft of swing drive unit 65 is inserted therethrough. A plurality of shafts 66 connected to ice-cracker drive unit 68 penetrate through cooling plate 16 and extend in the direction of ice-making unit 300. Through-holes in cooling plate 16 are provided with water sealing members 33 for sealing spaces around shafts 66. Water sealing members 33 are secured to cooling plate 16 by fixing plates 34.

Cooling plate 16 is provided with temperature detection means such as temperature sensor 35, and mounted to supporting member 61.

Supporting members 61 and 62 contain insulating materials 36 in them. Ice-making device 67 comprises ice-making vessel 503, cooling plate 16, water sealing members 30, ice-cracker drive unit 68, heat sink 69, Peltier device 14, fixing member 60, water-infiltration sealing member 31, supporting member 61, supporting member 62, shafts 66, water sealing member 33, fixing plates 34, temperature sensor 35 and insulating materials 36, and they are secured to one another. Ice-making device 67 is placed inside an ice-making compartment in a manner that its upper portion is housed in a space of generally a dome-shaped concaved portion formed in top surface 504 of the compartment. Supporting member 61 is closely located to the concaved portion in top surface 504 of the compartment to an utmost extent without interfering rotation of ice-making device 67 while minimizing circulation of the air through ice-making unit 300 and the ice-making compartment. Top surface 504 of the ice-making compartment is equipped with heating means (not shown) inside the concaved portion.

The automatic ice-making device constructed as above operates in a manner which is described hereinafter.

The water supplied by water pump 11 from water tank 10 through water supply pipe 11A is stored in a space of ice-making unit 300 bounded by ice-making vessel 503 and cooling plate 16. Ice-making vessel 503 has an open bottom from where cooling plate 16 is exposed. The water stored in ice-making unit 300 does not leak out because of water sealing member 30 placed between ice-making vessel 503 and cooling plate 16. Water sealing members 33 disposed around shafts 66 also prevent the water from leaking out of ice-making unit 300. Water sealing members 33 are formed of a rubber-like elastic material into an annular shape. These water sealing members 33 have one or more stages of fin-like configuration formed along their inner perimeters, and their inner diameters are smaller than the outer diameter of shafts 66. Moreover, the inner perimeters of water sealing members 33 are coated with grease to further improve the waterproofing property.

Supply of water to ice-making unit 300 is so controlled that water is fed little by little in number of divided steps rather than all at once, although it can hold 50 ml to 200 ml of water. The number of divided supplies and amount of water in each supply can vary depending on a size of ice block to be produced. In any case, a comparatively large amount of water is supplied in the first feeding, and the water is then reduced to a constant amount for the subsequent feedings.

The large amount of water is necessary for the first feeding in order to avoid clouds in the ice, since the water poured directly on cooling plate 16 for the first time is often chilled very rapidly, and it tends to become white cloudy. The amount of water for the subsequent feedings is so adjusted as to maintain a thin layer of unfrozen water on the surface of ice. An optimum thickness of the water layer is determined so that it helps the water to degas faster than the speed of freezing, and to remove the air of sufficient amount before the water becomes frozen.

To avoid the formation of clouds in the first supply of water, the surface temperature of cooling plate 16 needs to be regulated in advance to ensure a level higher than a predetermined temperature before supplying the water.

The ice is made in this manner by accumulating the amounts gradually inside ice-making unit 300. A timing of the water supply is so set that the new supply of water is made before the previous supply becomes completely frozen.

The reason of this is to avoid formation of a cloud layer in the ice due to the frost developed on the surface of ice from the previous supply of water if the water becomes completely frozen before new supply is made. The subsequent supplies of water are necessary before the water surface becomes completely frozen to realize an integral block of clear ice.

Peltier device 14 is in contact with a protruding part extending under cooling plate 16, and it cools cooling plate 16. Cooling plate 16 used here is made of a metallic plate of good thermal conductibility such as aluminum, and it has a thickness of 2 mm to 15 mm to obtain evenness of temperature throughout the cooling surface. Use of this structure allows a certain degree of flexibility in the arrangement of Peltier device 14.

The supplied water freezes gradually from the bottom side of cooling plate 16 while dispelling gaseous components in the water upward. On the other hand, a space surrounding ice-making unit 300 is thermally isolated by insulating materials 36 from the inner air of the ice-making compartment and heated by the heating means on top surface 504 of the ice-making compartment, which keep the ambient temperature around ice-making unit 300 higher than 0 deg-C. The top surface of the supplied water thus remains free from freezing. In this instance, ice-making vessel 503 may be heated directly by another heating means to obtain the like advantageous effect, instead of using the heating means disposed to the concave portion in top surface 504 of the ice-making compartment.

Temperature sensor 35 keeps monitoring the temperature of cooling plate 16, and performs control of the optimum freezing speed by properly regulating a voltage to Peltier device 14. In the case that the freezing speed is faster than the speed of degassing, for instance, the voltage to Peltier device 14 is regulated to raise the temperature of the cooling surface. If the freezing speed is slower, on the other hand, the voltage to Peltier device 14 is regulated so as to decrease the temperature of the cooling surface.

The ice grows upward into a convex shape as the time elapses after the start of ice making, and a distance of the frozen surface from cooling plate 16 also increases proportionally.

As a result, the grown ice itself has an effect of thermal insulation, which impedes conduction of the freezing effect. This fact necessitates gradual lowering of the temperature of the cooling surface in order to maintain the same freezing speed on the frozen surface. Such a control of the freezing speed can be achieved by gradually decreasing the voltage to the Peltier device with elapse of the time.

When this ice-making device 67 is disposed inside an ice-making compartment or a freezer compartment of a refrigerator, there is a case that the freezing speed becomes too fast in the initial stage of ice-making because of the effect of the surrounding temperature. In this case, the polarity of voltage applied to Peltier device 14 is reversed to heat the cooling surface for a given time duration from the start of ice-making in order to optimize the freezing speed. Subsequently, the polarity of voltage is reversed again after the given time has elapsed, to start the cooling of the cooling surface until the ice making is completed. When the polarity of the voltage is reversed, it is desirable to provide an interruption of the power supply for a certain time period for the sake of maintaining reliability of the useful life of Peltier device 14.

When the ice making is found started, swing drive unit 65 begins swinging ice-making device 67, which causes the supplied water inside ice-making unit 300 to flow smoothly across the ice surface from the upper side to the lower side by the force of gravity in response to the timing of inclination of ice-making unit 300. The ice surface becomes wet by the surface tension of water after the water flows therethrough, and thereby leaving an extremely thin layer of the water as observed microscopically. The swinging motion also stirs the water moderately, and expedites the degassing. The presence of the extremely thin layer of water substantially reduces the distance for air in the water to reach the boundary to the atmospheric air, and helps expediting the degassing.

Figure 21:
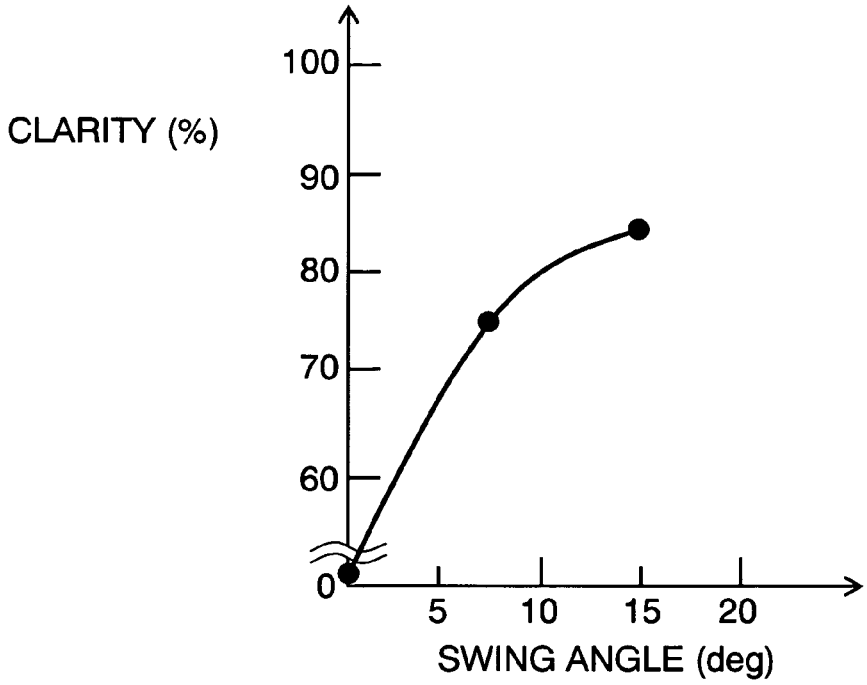
FIG. 21 is a graphic representation showing a relation between swing angle and clarity of ice in the ice-making device according to the eighth exemplary embodiment of this invention.

Clarity of the ice produced in ice-making vessel 503 changes depending on the swinging angle. FIG. 21 is a result of examination showing influence upon the clarity when the swinging angle is changed. As shown in FIG. 21, the clarity improves sharply as the swinging angle is increased up to about 10 degrees. This improvement of the clarity becomes blunt, however, when the angle exceeds 10 degrees. The supplied water tends to overflow from ice-making vessel 503 if the swinging angle is increased excessively. It is thus considered very appropriate to design the swinging angle of ice-making vessel 503 within a range of 10 to 20 degrees.

Figure 22:
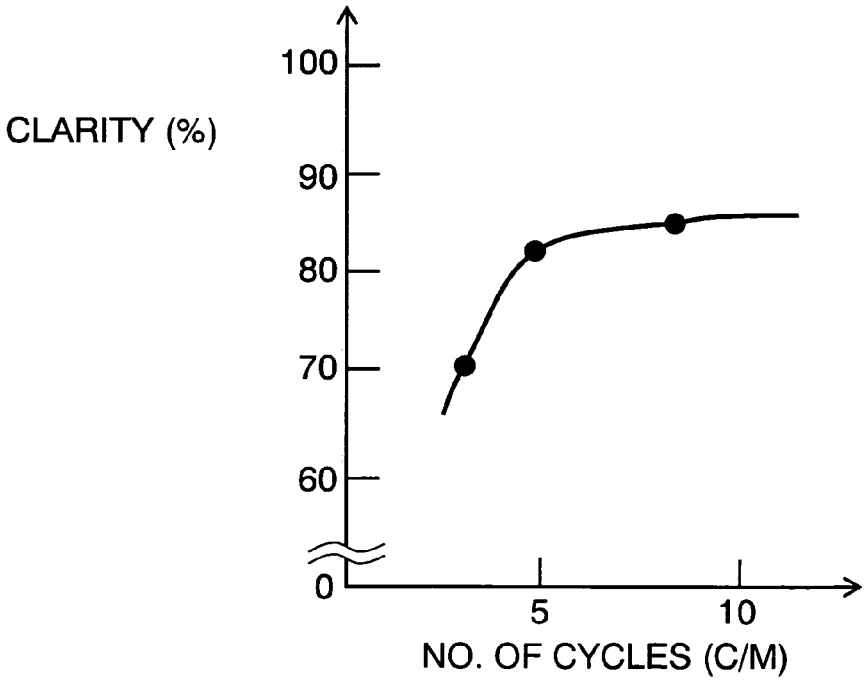
FIG. 22 is a graphic representation showing a relation between swing frequency and clarity of ice in the ice-making device according to the eighth exemplary embodiment of this invention.

Clarity of the ice produced in ice-making vessel 503 also changes depending on the swinging frequency. FIG. 22 is a result of examination showing influence upon the clarity when the swinging frequency is changed. As shown in FIG. 22, the clarity improves as a number of swinging cycles increases. The improvement of the clarity saturates, however, when the number is too many.

The reason of this is considered to be the fact that the excessive number of swinging cycles prevents the supplied unfrozen water from moving between one side to the other side of the ice-making vessel, but keeps the water to wave only in an area around the center of the vessel, thereby limiting movement of the water over the boundary of the ice surface.

This results in reduction of the gravitational effect of moving the water and loss of improvement in the clarity. On the other hand, produced ice gets a trace of white cloud attributable to partial freezing of the water near the boundary of the ice if the number of swinging cycles is too small. Swinging rates of 3 to 10 cycles per minute are considered suitable for improvement of the clarity. The water supplied in ice-making vessel 503 is freely movable across an entire width thereof since there is no wall in ice-making unit 300 that is generally perpendicular to the swinging direction. A movable distance of the supplied water in the example of this exemplary embodiment of the invention is substantially large as compared to the conventional ice-making vessel, which is normally divided into a plurality of sections.

However, the movable distance of the water may not be considered sufficient if sidewalls 503A of ice-making vessel 503 are perpendicularly formed with respect to the cooling surface. In addition, a growth rate of ice becomes somewhat faster along sidewalls 503A as compared to the center area due to heat conduction and surface tension along sidewalls 503A. For the above reason, there are often cases that white cloud appears in the center area along the swinging axis due to linearly formed air bubbles inside the ice block, when produced in an ice-making vessel having sidewalls 503A of perpendicular configuration.

It is for this reason that ice-making vessel 503 is so shaped that sidewalls 503A are sloped in a manner to gradually increase the surface area of ice toward the perpendicular direction from the cooling surface, in order to ensure a large movable distance for the water. The sidewalls of such configuration can also alleviate the influence of thermal conduction from the cooling surface. Therefore, the ice is made to grow around the center area of the swinging axis, that is the center of the ice-making vessel, to prevent the water from remaining unfrozen in the center area.

Moreover, the angle of slope influences the shape of the ice-making device. This is because a dimension of the sidewalls becomes larger with increase in angle of the slope, in order to maintain a certain thickness of the ice block. This influences the turning locus of ice-making unit 300 including ice-making vessel 503 when releasing ice, configurations of top surface 504 of the ice-making compartment and supporting members 61 and 62, as well as an overall volume of the entire ice-making device. An angle in the range of 10 to 30 degrees is thus determined suitable for the slope of the sidewalls of ice-making vessel 503. Any angle within this range can ensure the clarity of produced ice blocks while also prevent the water from overflowing the ice-making vessel.

The ice-making vessel of this invention as illustrated in this eighth exemplary embodiment has such configuration that sidewalls 503A are bent inward at areas exceeding the designed height of ice blocks. This configuration can reduce the turning locus of ice-making vessel 503 when it swings and releases the produced ice, and downsize ice-making device 67. Beside the above, the pause time at the largest swing angle also has a significant meaning in determining the swinging frequency. In other words, the pause time at the largest swing angle ensures the time required for the unfrozen water to move from one side wall to the other. It is therefore considered appropriate to provide a range of 3 to 7 seconds as a flow time for movement of the unfrozen water from side to side, while maintaining the water not becoming frozen on the ice surface at the same time.

It may be advisable to use these fact as specifications for the control of swinging frequency.

Ninth Exemplary Embodiment

Figure 16:
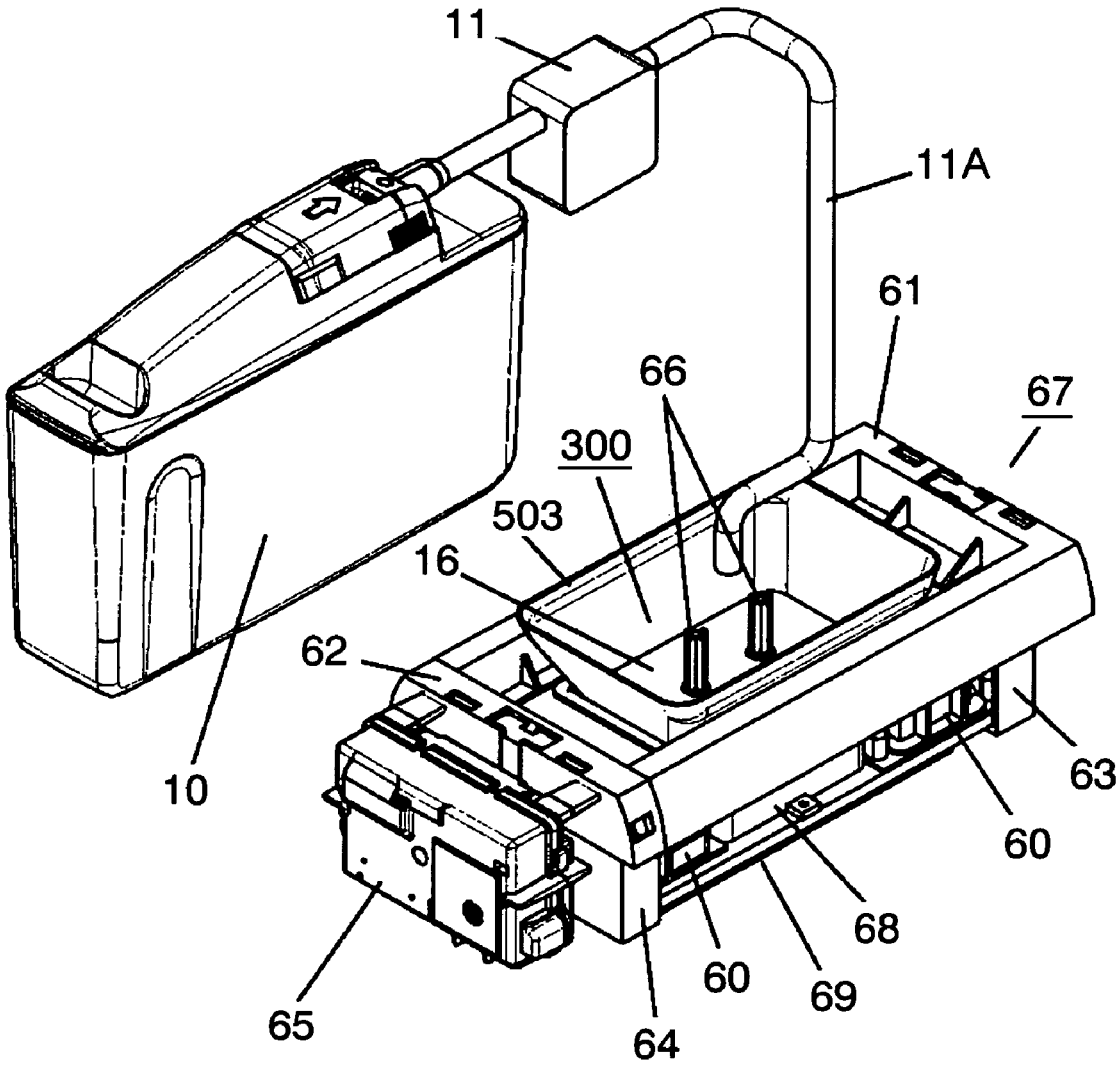
FIG. 16 is a perspective view of an ice-making device according to an eighth exemplary embodiment of this invention.
Figure 17:
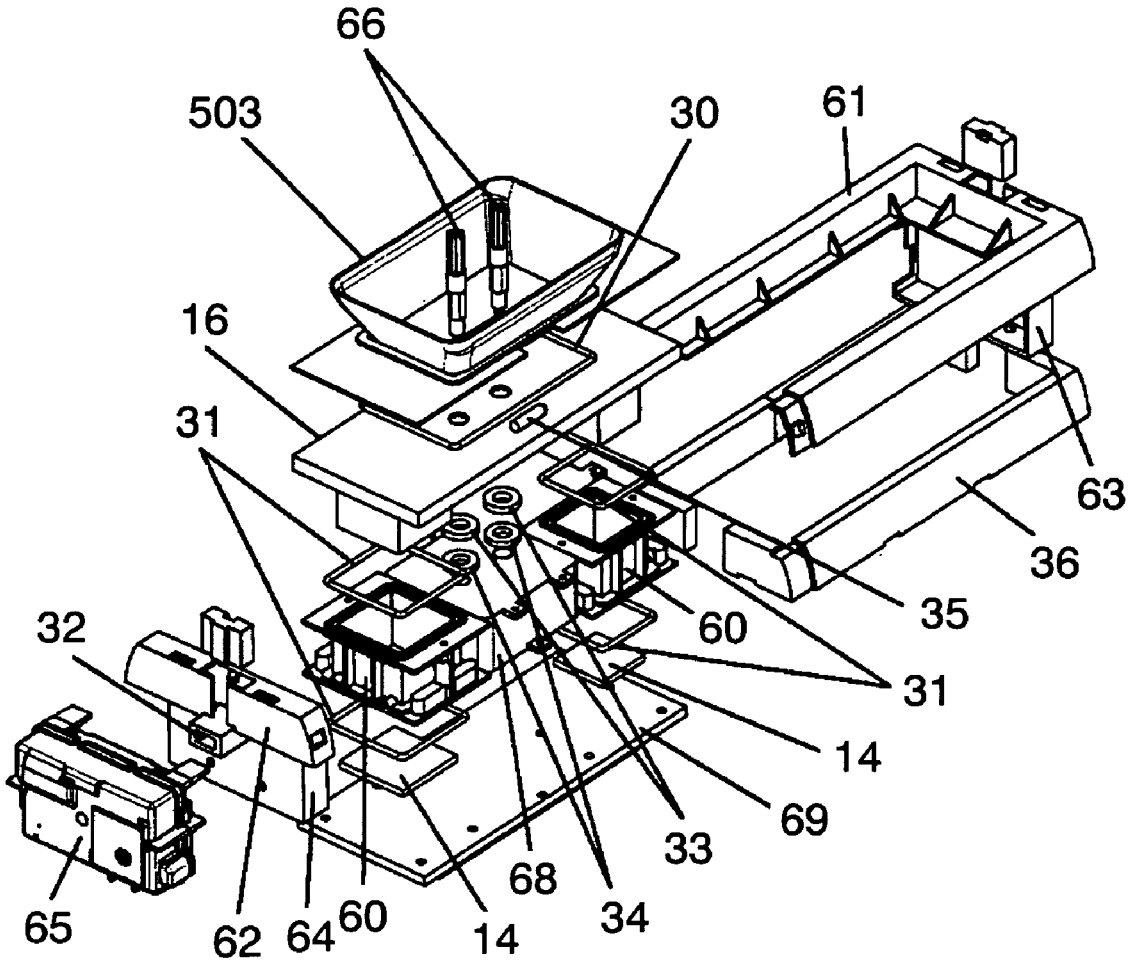
FIG. 17 is an exploded perspective view of the ice-making device according to the eighth exemplary embodiment of this invention.
Figure 18:
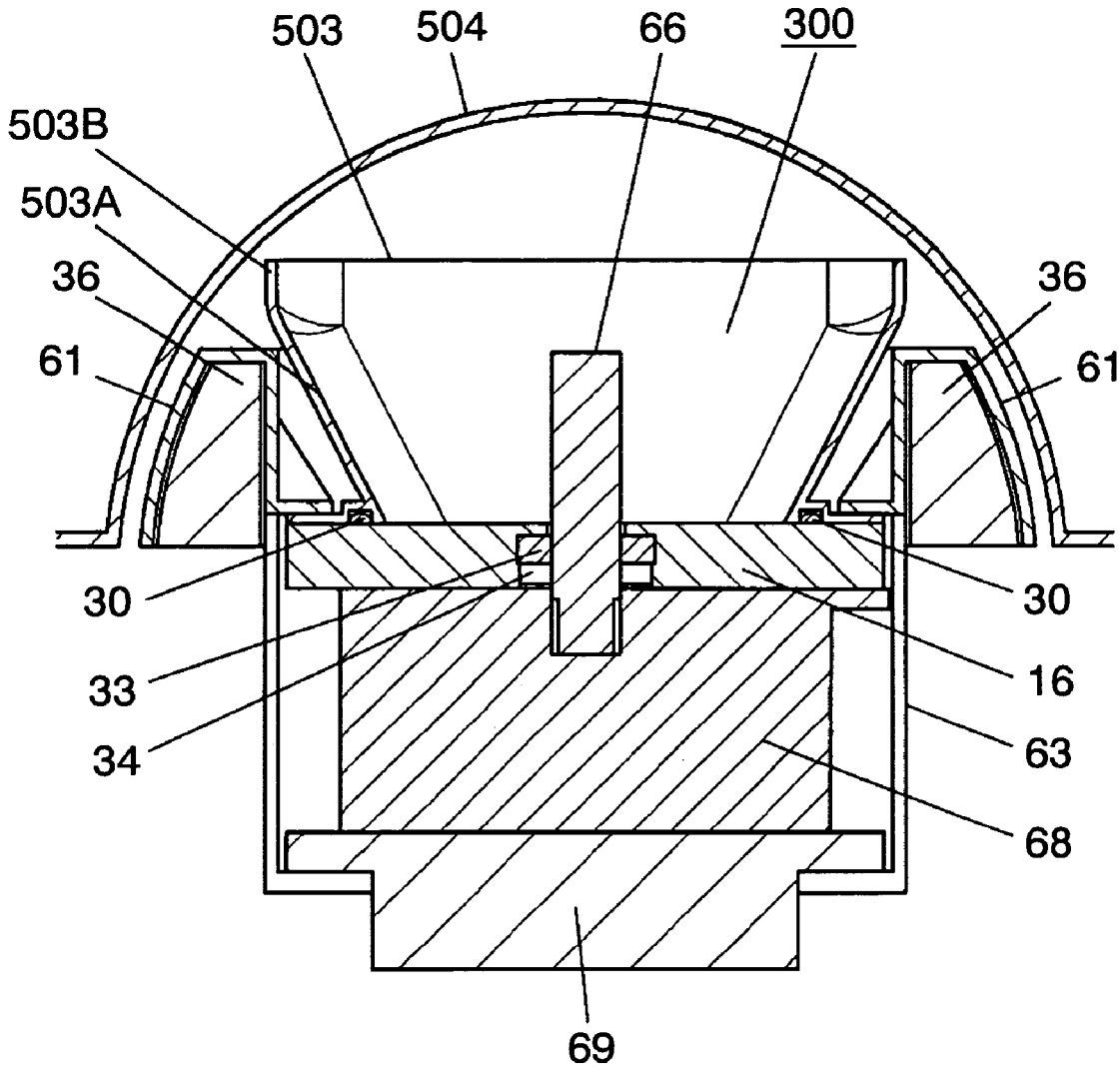
FIG. 18 is a sectional view of a main part of the ice-making device according to the eighth exemplary embodiment of this invention.
Figure 19:
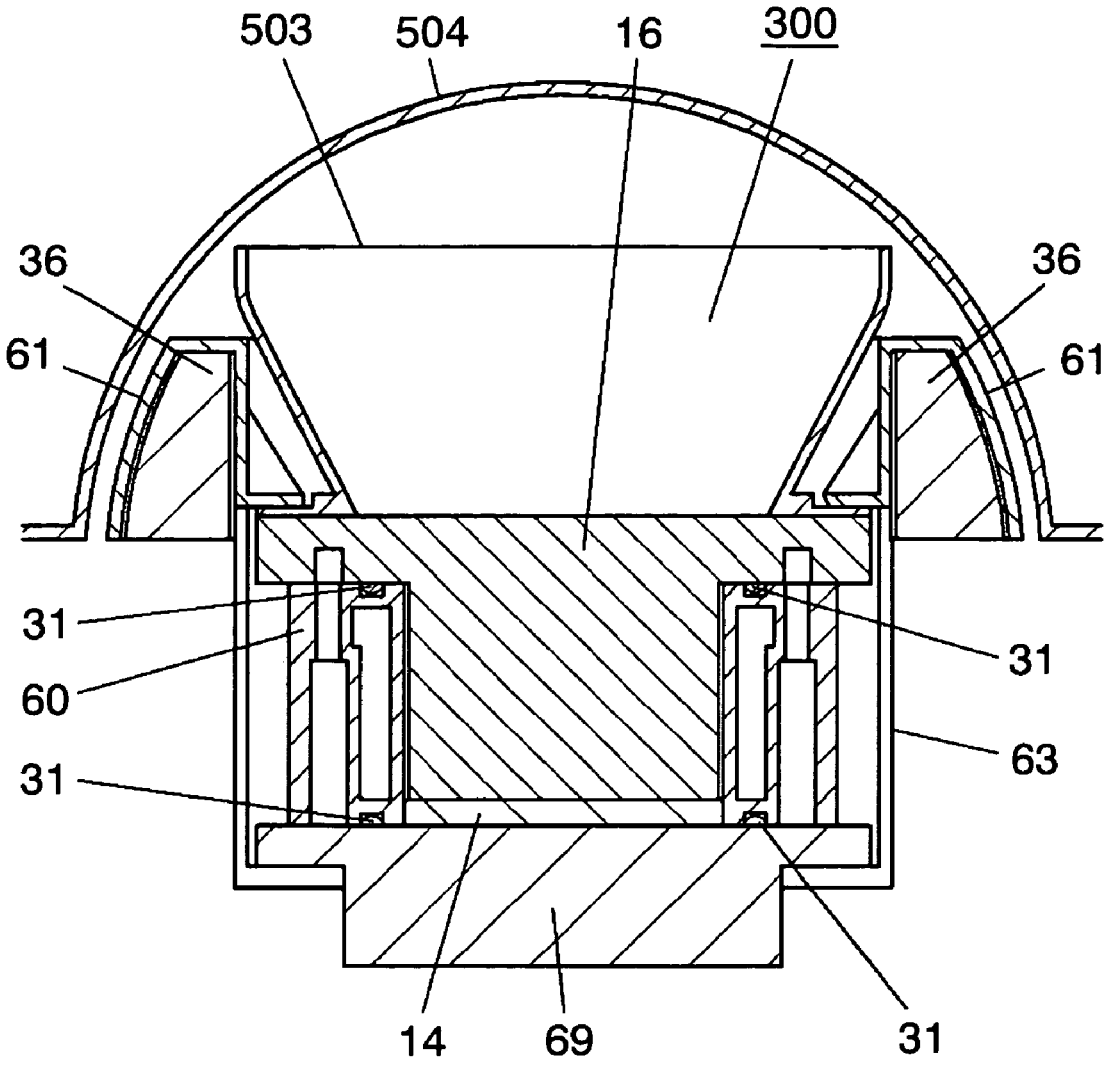
FIG. 19 is a sectional view of another main part of the ice-making device according to the eighth exemplary embodiment of this invention.
Figure 20:
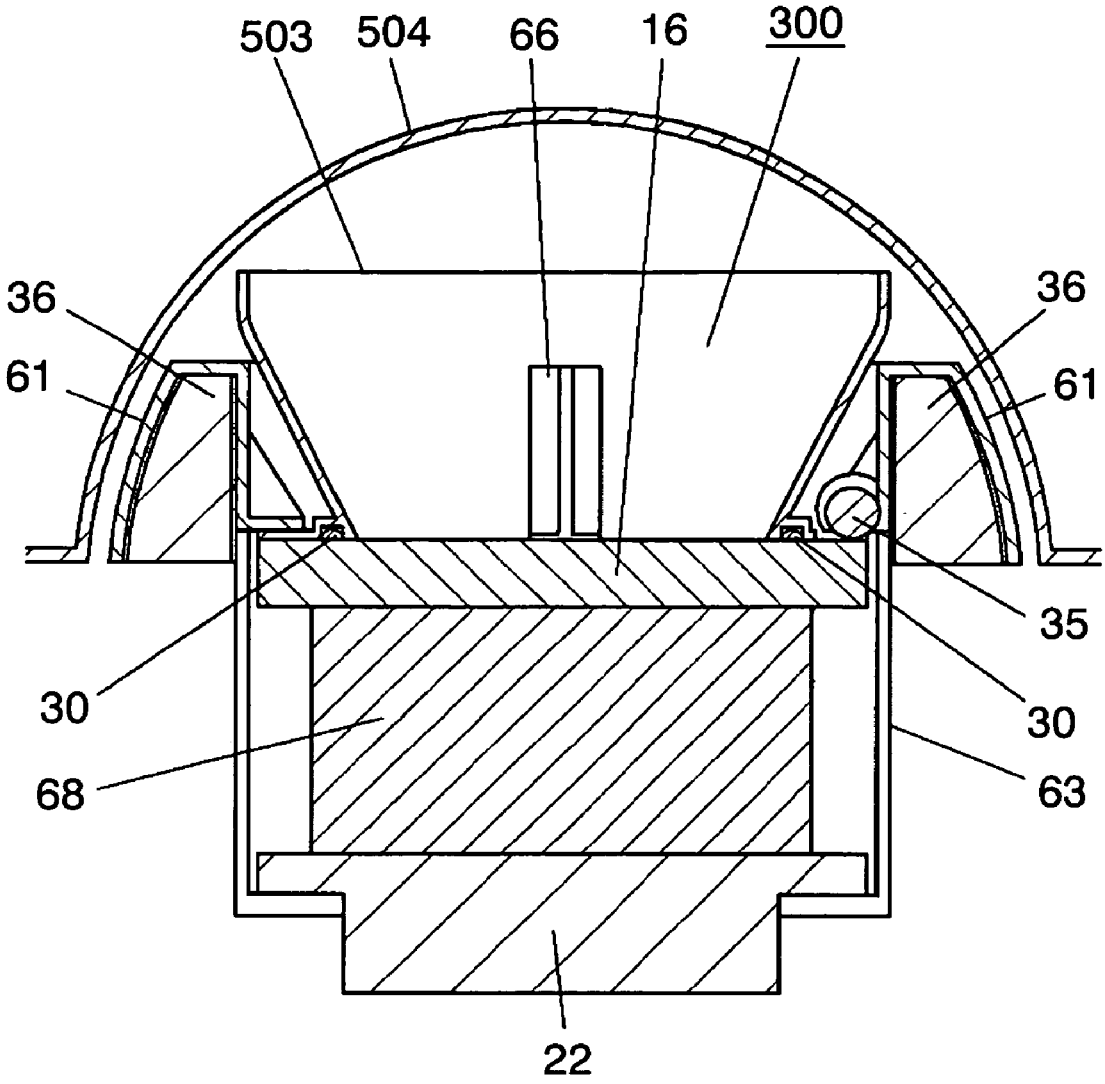
FIG. 20 is a sectional view of still another main part of the ice-making device according to the eighth exemplary embodiment of this invention.

Description is provided of the ninth exemplary embodiment with reference to FIG. 16 and Tables 1A through 1G.

Like reference numerals are used to designate like components as those of the eighth exemplary embodiment, and details of them will be skipped.

Water pump 11 functioning as an intermittent water supply means comprises a tube pump driven by a stepping motor. The stepping motor runs at a constant rotational speed responsive to a pulse rate, without being affected to a certain extent by variations in the supply voltage. The tube pump has a good advantage because of its inherent characteristic that accuracy of displacement is very high so long as the speed of a roller for squeezing a tube is kept constant. A result of these is the high water-supply accuracy when used to control intermittent supply of water. On the other hand, gear pumps and impeller pumps receive serious influences from variations in resistance of water supply channels and passages, although they are used for ice-making devices in general because of their advantage of comparatively low cost. Gear pumps and impeller pumps are therefore not so suitable for water supply of small amount because of the low water-supply accuracy as opposed to tube pumps.

The ice-making device having the above structure operates in a manner as will be described hereinafter.

When a temperature sensor detects a temperature of cooling plate 16 as being within a predetermined temperature range, water pump 11 operates for a certain number of steps to supply a predetermined amount of water to ice-making unit 300. At the same time, swing drive unit 65 starts swinging ice-making unit 300. The swinging operation is repeated at a predetermined swing cycle until the ice making is completed.

After the first supply of the predetermined amount water, water pump 11 takes a pause of a predetermined period, restarts again to supply another predetermined amount of water to ice-making unit 300, takes another pause of the predetermined period, and restarts again to supply the predetermined amount of water. Water pump 11 repeats the intermittent water supply until water of a predetermined amount is supplied to ice-making unit 300. When the water supply is completed, the stepping motor operates water pump 11 in the reverse direction to retract the water left inside water supply pipe 11A and return it into water tank 10.

To make ice of high clarity, it is necessary to keep the speed of air bubbles to escape from the unfrozen water to the surrounding air than the freezing speed.

In the ice-making device of this exemplary embodiment, the freezing speed of water at various thickness of the ice during the process of ice-making affects substantially to the clarity of ice, because the ice grows upward from the bottom generally in two dimensionally. It is therefore effective to slow down the freezing speed to make ice of better clarity. In view of convenience for the user, on the other hand, it is desirable to make an ice block of appropriate thickness within the shortest possible time, and sufficient consideration needs to be given on the intended thickness of the finalized ice, and the ice-making time to complete the ice block of desired thickness. It is quite difficult to control the freezing speed since the freezing speed decreases gradually with increase in thickness of the ice due to the ice acting as a resistance against thermal conduction of the cooling plate, if a cooling capacity of the cooling plate is kept constant. In this exemplary embodiment, the ice-making device is equipped with Peltier device 14 as a cooling source of cooling plate 16.

A cooling capacity of Peltier device 14 is variable by means of changing the supply current to it, and this realizes such control as to obtain the optimum freezing speed at any point of varying thickness of the ice.

Here, ice-making unit 300 is swung during the ice making to move the water on the boundary of ice in order to promote the release of air bubbles into the surrounding atmosphere. As stated, the width and the swinging angle of ice-making unit 300 substantially influence the clarity of ice as the water is moved by the swinging motion in the direction perpendicular to the swinging axis. Additionally, what is important among the factors in the swinging cycle that influence the clarity of ice is a time to pause the ice-making unit while being tilted. This reason is clear because the purpose of the swinging motion is to flow unfrozen water over the surface of ice to separate adhesion of air bubbles formed on the boundary of the water and the ice.

When ice-making unit 300 is paused while kept tilted during the swinging cycle the unfrozen water flows on the surface of ice, and this exposes a part of the ice surface. However, the intermittent supply of water recovers the entire ice surface wet once the water is flown over it. Since the extremely thin layer of water can be produced in this manner, this helps shorten the distance for the air bubbles to get released and expedite the degassing. Accordingly, the amount of water supplied each time and supply intervals greatly influence the clarity in this intermittent water supply.

Table 1 shows the result of experiments performed on the ice-making device of this exemplary embodiment, in which changes in the clarity are checked while changing total amount of supplied water (i.e., thickness of ice), bottom width of ice-making vessel, number of divided water supplies, amount of each water supply, swinging angle, swinging cycle, and ice-making time.

In these experiments, sidewalls of the ice-making vessel were sloped so that a surface area increases gradually toward the upper direction perpendicular to the bottom surface. Because of this slope, an increase in depth of water supplied over the ice surface decreases gradually as the number of water supplies accumulates even when water of the same amount is supplied each time at the same interval.

The swinging cycle was so adjusted that the ice-making unit moves approx. 1 second to make a full swing of the predetermined angle, and stays paused at the tilted position for the remainder of the time. When a condition was given that the swinging angle is ±15 degrees at the swinging cycle of 5 cycles/minute, for example, one cycle consisted of 1 second for the swing of 30 degrees from −15 to +15 degrees, 5 seconds of pause at the +15-degree position, 1 second for another swing of 30 degrees from +15 to −15 degrees, and 5 seconds of another pause at the −15-degree position.

Although a greater effect is anticipated by increasing the swinging angle, it requires higher sidewalls of the ice-making vessel to avoid overflow of the water from the sidewall during the pause period in which the ice-making unit is held tilted.

Since the ice-making device could become too large, the angle of tilt was limited to 15 degrees.

In respect of the thickness of ice blocks, an evaluation was made with the appropriate thickness considered to be easy to use in the standpoint of users. If ice blocks are too thick, convenience of use is not so good because cracked pieces of the ice become too large for use in small glasses and the like containers. If ice blocks are too thin, on the other hand, their exterior appearance becomes poor and loose worthiness of use. Accordingly, thicknesses between 15 mm and 25 mm were used for this evaluation.

In respect of the amount of water in the intermittent water supply, the amount for the first supply was determined to be somewhat more than amount of the subsequent supplies, and that is sufficient to raise approx. 5 mm of water depth on the ice-making unit, to prevent it from being frozen quickly before spreading over the cooling plate.

The ice-making time was set to 120 minutes based on the time normally required to make ice cubes by conventional ice-making device. In this case, the voltage supplied to the Peltier device was gradually changed and so adjusted that the freezing speeds does not vary excessively at points of varying ice thicknesses, and none of the freezing speeds is extremely fast. The evaluation was also made under the conditions in which the ice-making time exceeds 120 minutes in consideration of the importance on the clarity of ice blocks.

In this evaluation for the experimental results, the clarity of ice blocks were classified into four levels of quality: "A" for excellent level of clarity with very little apparent cloudiness (good clarity over 90% of the overall volume of the ice block); "B" for high level of clarity with little apparent cloudiness (good clarity over 70% but not exceeding 90% of the overall volume of the ice block); "C" for fair level of clarity with sporadic apparent cloudiness, satisfactorily useable as compared to ice blocks made by ordinary ice-making device (clarity over 50% but not exceeding 70% of the overall volume of the ice block); and "D" for poor level of clarity with similar degree of cloudiness as ice blocks of ordinary ice-making device (clarity not exceeding 50% of the overall volume of the ice block). Any of ice blocks classified "B" or above is regarded as relatively high clarity and sensually excellent.

The classifications of "A", "B", "C" and "D" represent "excellent", "good", "fair" and "poor" respectively. The expression of "±15 deg" means a swing motion consisting of a 15-degree movement in one direction (positive direction), and another 15-degree movement in the opposite direction (negative direction).

Embodied sample 1 through 18 shown in Table 1A are the complete results of these experiments performed on the ice-making device of this exemplary embodiment, in which changes in the clarity are checked while changing the total amount of supplied water (i.e., thickness of ice), bottom width of the ice-making vessel, number of divided supplies of water, amount of water at each supply, swinging angle, swinging cycle, and ice-making time. Table 1B through Table 1G show the relations between different values of the individual factors and the clarities, and of their comparisons on the experiments as tabulated in Table 1A. Detailed results of these experiments will be given below.

Table 1B shows the result of experiment made to confirm whether clear blocks of ice can be made by changing only the ice-making time when water of a fixed amount is put in the ice-making vessel without making swing motion and intermittent water supply.

This experiment was carried out by making ice blocks of 15 mm thick, which is considered the smallest limit in light of convenience for the user side.

According to Table 1B, the ice block made within the 120-minute duration (sample 14) resulted in the clarity of "D" (the clarity not exceeding 50% of the overall volume of the ice block) containing similar degree of cloudiness as the ice block made with the ordinary ice-making device. On the other hand, the ice block made by cooling slowly in the time duration of 240 minutes (sample 15) resulted in the clarity of "C" for the satisfactory level of clarity (the clarity over 50% but not exceeding 70% of the overall volume of the ice block) as compared to ice blocks made by ordinary ice-making device although it had white clouds sporadically. However, this method would require a substantially long hours for a thick block of ice, since it needed the 240 minutes of long time to make the ice block of the smallest thickness of 15 mm. It was known that ice block of only fair clarity is obtainable even if many hours are spent for it. Further improvement is thus needed because it is preferable to obtain an ice block of good clarity in about 120 minutes in consideration of the user's needs.

Table 1C shows the result of experiment made to check the clarity by varying the thickness of ice blocks made with swing motion under certain condition, but without making intermittent water supply.

According to Table 1C, the ice block having 15 mm in thickness (sample 13) was made with sufficiently good clarity at the level "B" (good clarity over 70% but not exceeding 90% of the overall volume of the ice block) although it showed small number of white clouds locally. However, the clarity was found decreased gradually with the increase in thickness of the ice block to 20 mm (sample 6) and 25 mm (sample 16).

Table 1D shows the result of experiment made to check the clarity of ice blocks made by varying the width of the bottom surface of the ice-making vessel in the direction perpendicular to the swing axis while making swing motion and intermittent water supply under certain condition.

According to Table 1D, the ice block made with the ice-making vessel of 40 mm in the bottom width (sample 2) resulted in the clarity level "C" having enough clarity (the clarity over 50% but not exceeding 70% of the overall volume of the ice block) as compared to ice blocks made by ordinary ice-making device although it contained white clouds sporadically.

The ice block made with another ice-making vessel having the bottom width extended to 60 mm (sample 3) resulted in the clarity level "B" with sufficiently good clarity (the good clarity over 70% but not exceeding 90% of the overall volume of the ice block) although it showed small number of white clouds locally. This result was attributable to the wide bottom surface of the ice-making vessel which gave a large distance for the water to move during the swing motion, and to expedite the degassing in the water, which in turn improved the clarity. It was hence determined that improvement of the clarity is possible by further extending the width of the ice-making vessel. Additional experiment was also made with an ice-making vessel having a bottom width of 80 mm, although not shown in Table 1D. The result showed that the water overflows under the same swing condition unless the height of the ice-making vessel is raised considerably. It was thought to be difficult to increase the width of the ice-making vessel to 80 mm in consideration of the restrictions in design of domestic refrigerators, since the ice-making vessel takes a large space when making a turning motion every after the end of ice-making.

Table 1E shows the result of experiment made to check the clarity of ice blocks made by varying only the swinging angle while maintaining the same swinging cycle and the intermittent water supply under certain condition.

According to Table 1E, the ice block made with the swinging angle of ±5 degrees (sample 8) resulted in the clarity of "D" containing similar degree of cloudiness as the ice block made with the ordinary ice-making device (the clarity not exceeding 50% of the overall volume of the ice block). The clarity improved to level "C" when the swinging angle was increased to ±10 degrees (sample 7), and to level "B" when the swinging angle was ±15 degrees (sample 3). It was thus known that the clarity can be improved by increasing the swinging angle. Additional experiment was also made with the swinging angle of ±20 degrees, although not shown in Table 1E. The result showed the water overflows under the same swing condition unless the height of the ice-making vessel is raised considerably. It is difficult to increase the swinging angle of the ice-making vessel to 20 degrees within any domestic refrigerator due to the restrictions in design.

Accordingly, it is considered preferable to maintain the swinging angle in the range of 10 degrees to 20 degrees to avoid bulkiness of the ice-making device as previously stated, though large effect may be anticipated with large swinging angle.

Table 1F shows the result of experiment made to check the clarity of ice blocks made by varying the swinging cycle while maintaining the same swinging angle and the intermittent water supply under certain condition.

According to Table 1F, the ice block made with the swinging cycle of 2 cycles/min (sample 9) resulted in the clarity of "D" containing similar degree of cloudiness as the ice block made with the ordinary ice-making device (the clarity not exceeding 50% of the overall volume of the ice block). It is thought that this is attributable to deficiency of the degassing because of stagnation in the flow of water during the swinging motion. The ice block of clarity level "B" was achieved when the swinging cycle was increased to 5 cycles/min (sample 3) with sufficiently good clarity (the good clarity over 70% but not exceeding 90% of the overall volume of the ice block) although it showed very small number of white clouds locally. The clarity decreased to level "C" when the swinging cycle was increased to 10 cycles/min (sample 17), and further to level "D" when the swinging cycle was increased 15 cycles/min (sample 10). The clarity of the ice blocks decreased as stated above when the swinging cycle was increased excessively. The reason of such decrease may be the fact that the water is unable to move a sufficiently long distance due to the short pause period in the tilted position which prevents the water from flowing across the ice surface in one direction before the ice surface starts tilting to the opposite direction. As a consequence, this does not allow the water to flow over the ice surface of enough distance, thereby preventing sufficient degree of degassing.

It was known accordingly that there are optimum ranges and conditions in the swinging cycle in relation with configuration of the ice-making vessel and amount of the water supply, and ice blocks of high clarity are producible only by way of controlling the swinging cycle within the optimum ranges.

Table 1G shows the result of experiment made to check the clarity of ice blocks made by varying the number of divided water feedings within the same ice-making time while maintaining the swinging operation under certain condition.

According to Table 1G, the ice block made with only a single supply of water (sample 6), rather than dividing the supply of water (i.e., intermittent water supply) resulted in the clarity level of "C" showing the satisfactory level of clarity (the clarity over 50% but not exceeding 70% of the overall volume of the ice block) as compared to ice blocks made by ordinary ice-making device although it contained white clouds sporadically.

When the ice block was made with the supply of water divided into 10 times (sample 5), on the other hand, the clarity was improved to level "B". The same high clarity level "B" was also achieved for the ice block made with the supply of water divided into 20 times (sample 3). This is believed to be attributable to the intermittent supply of water and the swinging operation, that the swinging motion can move the small amount of water effectively to help expedite the degassing in the water.

The clarity of the ice block was decreased to the level "C" when the number of divided water supplies was further increased to 30 times (sample 18), and to the level "D" for anther ice block if the number was increased to 40 times (sample 4), indicating the tendency of degradation. This phenomenon is thought to be the following. The increase in number of the divided supplies of water can help move a lesser amount of the water in the swinging motion to expedite the sufficient extent of degassing from the water. If the amount of the water is excessively small, however, the water tends to start freezing immediately after supplied, and it often becomes completely frozen before the subsequent supply of water. As the consequence, when this makes a complete frozen surface between the preceding and the succeeding supplies of water, the frozen surface remains cloudy in a form of thin layer when observed from the side of it, for instance. This is the phenomenon that reduces the clarity. As stated, the phenomenon of cloudiness develops for the different reason from that of the case with less number of divided water supplies. In order to avoid this layer of cloudiness, it is necessary to cover the frozen surface with water at all the time by feeding a new supply of water before the previously supplied water becomes frozen.

Accordingly, it was known that there are optimum ranges in the number of divided supplies of water in relation with the swinging conditions, the ice-making time and the like, and ice blocks of high clarity are producible only by way of controlling the number of divided supplies within the optimum ranges.

In brief, it was understood that the ice blocks of high clarity can be produced by controlling the number of divided supplies (i.e., intermittent water supply) as well as mutually related factors among the swinging cycle, swinging angle and the like upon determination of the allowable dimension of the bottom width in design of the ice-making vessel, when the making the ice blocks within the shortest time possible.

According to this exemplary embodiment, the optimum number of divided supplies of water can be in a range of 10 to 20 times for an ice-making device having an ice-making vessel with a bottom width of approx. 60 mm, provided that the ice-making time is 120 minutes, swinging angle is approx. ±15 degrees, and swinging cycle is about 5 cycles/min (samples 3 and 5). These conditions could provide ice blocks of clarity level "B" which have sufficiently good clarity although it showed very small traces of white clouds (the good clarity over 70% but not exceeding 90% of the overall volume of the ice block).

When the ice-making time is increased to twice as long as 240 minutes under the same conditions as above, the result was an ice block with the clarity level "A" (good clarity over 90% of the overall volume of the ice block) having very high level of clarity with very little apparent cloudiness (sample 11).

When the thickness of ice block is reduced to about 15 mm under the same conditions as above (the conditions for samples 3 and 5), there was an ice block of the clarity level "A" (good clarity over 90% of the overall volume of the ice block) having very high level of clarity with very little apparent cloudiness. It was also found that an ice block of the clarity level "B" is producible without making the intermittent water supply but only with the swinging operation (sample 13), if thickness is reduced to about 15 mm, the clarity of which is sufficiently good although there were very small traces of white clouds (the good clarity over 70% but not exceeding 90% of the overall volume of the ice block).

In other words, clear ice blocks are producible, if their thickness is about 15 mm, without employing an expensive water pump and the like for intermittent water supply, but only a less expensive ordinary water pump used in the past. An ice-making device capable of producing clear ice blocks can be realized in this way at very low cost.

It was also found that ice blocks of comparatively high clarity can be made with an ice-making device employing the water pump using a relatively inexpensive gear pump or impeller pump commonly used for the ordinary ice-making device, even if thickness of the ice blocks is 15 mm or larger, provided that certain conditions such as the swinging operation are arranged properly.

As described above, there are a variety of conditions that realize clear ice blocks with the effect of the swinging motion so long as the ice-making time is approx. 120 minutes and the thickness of the ice blocks is about 15 mm, although it depending on the ways of arranging the thickness and ice-making time.

It is also possible to produce ice blocks of even higher clarity by providing the ice-making device with a special-purpose water pump capable of supplying a small amount of water.

It is also feasible to adopt a method of improving the accuracy of supplying water of a small amount using any of gear pump and impeller pump in which a resistance of water passage is intentionally increased by reducing an outlet aperture of the pump to prolong the operating time needed for supply of the predetermined amount of water. Use of the above method enable the intermittent water supply with a comparatively low cost.

It should be understood that the samples discussed in this exemplary embodiment are not intended to restrict the individual parameters. The clarity of ice blocks can be improved in still many other ways by selecting suitable combinations.

Tenth Exemplary Embodiment

Description is provided of the tenth exemplary embodiment with reference to FIG. 16 through FIG. 20.

Since an ice-making device of this exemplary embodiment has the same structure as that of the eighth exemplary embodiment, details of it will be skipped.

Water supplied by water pump 11 from water tank 10 through water supply pipe 11A is stored in a space of ice-making unit 300 bounded by ice-making vessel 503 and cooling plate 16. Ice-making vessel 503 has an open bottom from where cooling plate 16 is exposed. The water stored in ice-making unit 300 does not leak out because of water sealing member 30 placed between ice-making vessel 503 and cooling plate 16. Water sealing members 33 disposed around shafts 66 also prevent the water from leaking out of ice-making unit 300. Water sealing members 33 are formed of a rubber-like elastic material into an annular shape. These water sealing members 33 have one or more stages of fin-like configuration formed along their inner perimeters, and their inner diameters are smaller than the outer diameter of shafts 66. Moreover, the inner perimeters of water sealing members 33 are coated with grease to further improve the waterproofing property.

Supply of water to ice-making unit 300 is so controlled that water is fed little by little in number of divided steps rather than all at once, although it can hold 50 ml to 200 ml of water. The number of divided supplies and amount of water in each supply can vary depending on a size of ice to be produced, and it may be arranged in a range of 5 times and 25 times. In any case, a comparatively large amount of water is supplied in the first feeding, and the water is then reduced to a constant amount for the subsequent feedings.

The large amount of water is necessary for the first feeding in order to avoid the ice from getting cloudy due to the water being frozen very rapidly when the small amount of water is supplied. The amount of water for the subsequent feedings is so adjusted as to maintain a thin layer of unfrozen water on the surface of ice. An optimum thickness of the water layer is determined so that it helps the water to degas faster than the speed of freezing, and to remove the air of sufficient amount before the water becomes frozen. The ice is made in this manner by accumulating the amount gradually inside ice-making unit 300. A timing of the water supply is so set that the new supply of water is made before the previous supply becomes completely frozen. The reason of this is to avoid formation of a cloud layer in the ice due to frost developed on the surface of ice from the previous supply of water if the water is completely frozen before new supply is made. The subsequent supplies of water are necessary before the water surface becomes completely frozen to realize an integral block of clear ice.

An ambient temperature in a space surrounding ice-making unit 300 is kept higher than 0 deg-C. since a concaved portion in top surface 504 of the ice-making compartment is heated by a heating means and the space is thermally isolated by insulating materials 36 from the inner air of the ice-making compartment. In this instance, ice-making vessel 503 may be heated directly by another heating means to obtain the like advantageous effect, instead of using the heating means disposed to the concave portion in top surface 504 of the ice-making compartment. Peltier device 14 is in contact with a protruding part extending under cooling plate 16, and it cools cooling plate 16. Cooling plate 16 used here is made of a metallic plate of good thermal conductibility such as aluminum, and it has a thickness of 2 mm to 15 mm to maintain evenness of temperature throughout the cooling surface.

Use of this structure allows a certain degree of flexibility in the arrangement of Peltier device 14.

When cooling plate 16 reaches a freezing temperature, it starts freezing the supplied water gradually from the bottom side while dispelling gaseous components in the water upward.

Through this duration, the top surface of supplied water remains free from freezing since the ambient temperature around ice-making unit 300 is kept higher than 0 deg-C. Temperature sensor 35 keeps monitoring a temperature of cooling plate 16, and performs control of the optimum freezing speed by properly regulating a voltage to Peltier device 14. In the case that the freezing speed is faster than the speed of degassing, for instance, the voltage to Peltier device 14 is reduced.

The ice grows upward as the time elapses after the start of ice-making, and a distance of the frozen surface from cooling plate 16 also increases proportionally. In order to maintain the freezing speed on the frozen surface constant, it is necessary to gradual lower the temperature of the cooling surface. Such a control of the temperature can be achieved by gradually decreasing the voltage to the Peltier device with passage of the time.

This ice-making device 67 is disposed inside an ice-making compartment or a freezer compartment of a refrigerator. Under this circumstance, there is a case that the freezing speed becomes too fast in the initial stage of ice-making because of an effect of the surrounding temperature. In this case, the polarity of voltage applied to Peltier device 14 is reversed to heat the cooling surface for a given time duration from the start of ice-making in order to optimize the freezing speed. Subsequently, the polarity of voltage is reversed again to start the cooling of the cooling surface until the ice-making is completed.

When temperature sensor 35 detects a temperature rise of cooling plate 16 and determines that the water supply is completed, swing drive unit 65 starts repeating a normal-to-reverse rotation at a given frequency and a given amplitude to swing ice-making device 67. As a consequence of this operation, the water supplied inside ice-making unit 300 starts flowing smoothly across the ice surface from the upper side to the lower side by the force of gravity in response to the timing of inclination of ice-making unit 300. The ice surface becomes wet after the water flows therethrough, thereby leaving an extremely thin layer of the water as observed microscopically. The swinging motion also stirs the water moderately, and expedites the degassing. The presence of the extremely thin layer of water substantially reduces the distance for air in the water to reach the boundary to the atmospheric air, and helps expedite the degassing.

The water supplied inside ice-making vessel 503 is freely movable across an entire width thereof since there is no wall in ice-making unit 300 that is generally perpendicular to the swinging direction. A movable distance of the supplied water in this exemplary embodiment is substantially large as compared to the conventional ice-making vessel, which is normally divided into a plurality of sections.

This structure improves the effect of degassing so as to produce an ice block of high clarity inside ice-making unit 300. Or, it can shorten the ice-making time if agreeable with equivalent clarity to those generally made available by the conventional ice-making device.

Temperature sensor 35 detects a temperature drop of cooling plate 16 to determines the ice-making is completed. The clear ice block made in this manner is generally plank-shaped. At this completed state, the clear ice block contains shafts 66 in it, and these shafts 66 are driven by ice-cracker drive unit 68 to rotate in a predetermined direction. Each of shafts 66 is provided with a plurality of ribs or claws protruding in the radial direction. Rotation of these ribs causes the generally plank-shaped ice block to crack in areas around the ribs, and breaks the clear ice block into a plurality of pieces. It is desirable that these cracked ice pieces are properly sized for practical use in the ordinary households.

After the ice block is cracked, swing drive unit 65 turns ice-making device 67 into upside down to release and let the clear ice pieces in ice-making unit 300 fall downward. Afterwards, swing drive unit 65 turns in the opposite direction to return ice-making device 67 into the right position for waiting the subsequent supply of water.

If shafts 66 and ice-cracker drive unit 68 are not constructed into a single assembly, both shafts 66 and ice-cracker drive unit 68 need to be moved from the upper side of ice-making unit 300 toward the ice block after the ice block is formed. If this is the case, certain kind of heating means becomes necessary in order to insert shafts 66 into the ice block. Such an ice-making device also requires additional moving means for moving shafts 66 and ice-cracker drive unit 68 in the vertical direction.

It also gives rise to an increase of the ice-making time since the ice block requires refreezing for cracking after shafts 66 are inserted in the ice block with the aid of the heating means.

As has been described, the ice-making device of this exemplary embodiment comprises the cooling plate, the ice-making vessel having an open top and disposed on the cooling plate, the swing mechanism for swinging the ice-making vessel, and the water supply mechanism for supplying water to the ice-making vessel, wherein the device is capable of freezing the water while simply making the water flow over an ice surface by the force of gravity, by way of adjusting the amount of water supply and timing, forming a thin layer of unfrozen water, and swinging the ice-making vessel.

The ice-making device supplies water in number of divided steps, in which an amount of water is increased for the first supply while an amount is fixed for the subsequent supplies, with the total number of supplies ranging between 5 and 25 times, and carries out the supplies of water in a sequential manner before the water in the ice-making vessel becomes completely frozen by setting the supply timing appropriately.

The ice-making device can gradually lower the temperature of the bottom surface of the ice-making vessel, or the surface of the cooling plate, beginning from the start of ice-making, by controlling it with the temperature detection means mounted to the ice-making unit.

The cooling plate is made of a metallic plate of good thermal conductibility having a thickness ranging between 2 mm and 15 mm to maintain uniform temperature throughout its surface.

The ice-making device uses a Peltier device for cooling the cooling plate, and thereby it can regulate temperature of the cooling surface to the optimum temperature.

The method of controlling power supply to the Peltier device includes reversing the polarity of the supply voltage when a predetermined time is elapsed after the start of the ice-making, to change the cooling and heating of the cooling surface.

The ice-making device further comprises a heating means disposed to the ice-making vessel or in the vicinity thereof for controlling the surrounding temperature of the ice-making vessel in order to prevent the water on the surface of the ice-making unit from freezing.

Eleventh Exemplary Embodiment

Figure 23:
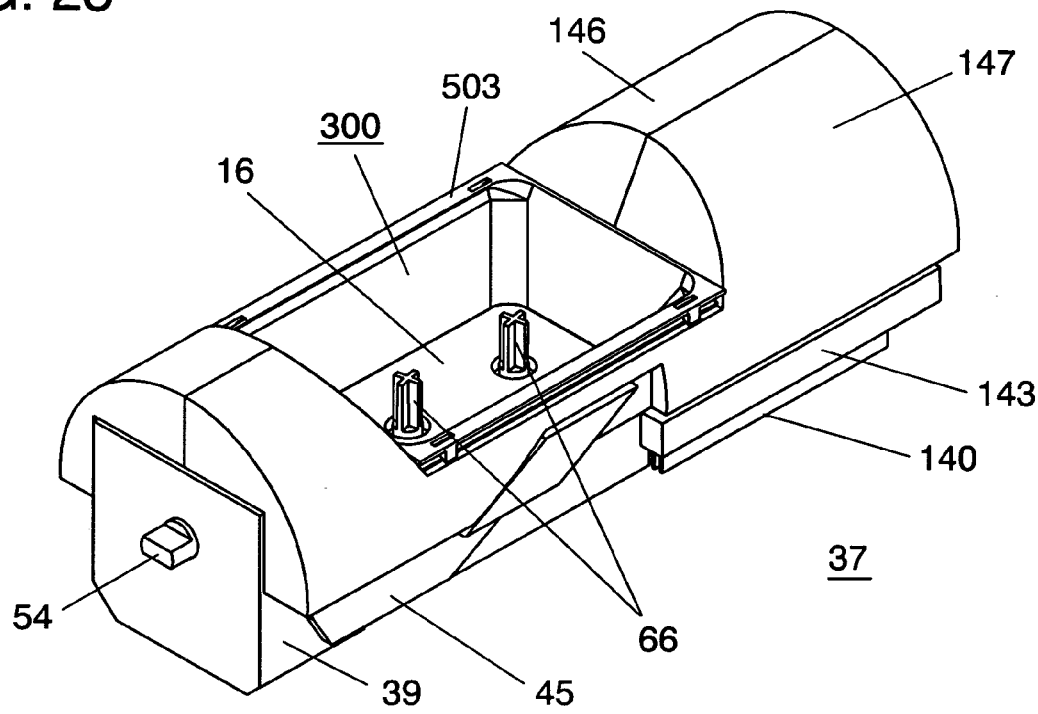
FIG. 23 is a perspective view of an ice-making device according to an eleventh exemplary embodiment of this invention.
Figure 24:
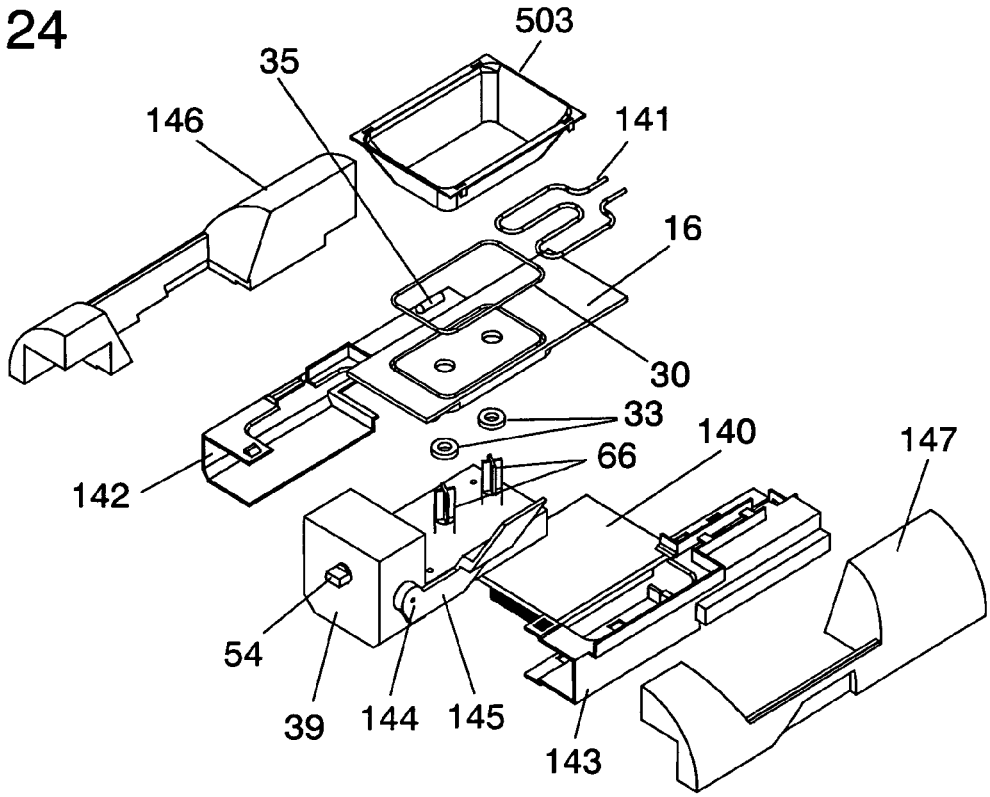
FIG. 24 is an exploded perspective view the ice-making device according to the eleventh exemplary embodiment of this invention.

Description is provided of an ice-making device of the eleventh exemplary embodiment with reference to FIG. 23 and FIG. 24.

Like reference numerals are used to designate like components as those of the eighth exemplary embodiment, and details of them will be skipped.

Ice-making unit 300 comprises ice-making vessel 503 having an open top and open bottom for temporarily storing water and making a plank-shaped block of ice, cooling plate 16, and water sealing member 30 disposed between ice-making vessel 503 and cooling plate 16. Drive unit 39 is disposed underneath cooling plate 16. Cooling accelerate member 140 having a fin configuration is disposed behind drive unit 39 and under cooling plate 16 in a manner to make close contact to cooling plate 16. Both cooling plate 16 and cooling accelerate member 140 are formed of a material of good thermal conductivity such as aluminum. In addition, heater 41 is disposed to cooling plate 16 in a location outside of but close to ice-making vessel 503, for heating cooling plate 16.

Ice-making vessel 503, cooling plate 16, water sealing member 30, drive unit 39 and cooling accelerate member 140 are assembled in a manner to be sandwiched from the top and bottom by supporting members 142 and 143.

In this structure, ice-making vessel 503 is pressed in the directions of cooling plate 16 by supporting members 142 and 143, while also imposing a moderate compression on water sealing member 30.

A plurality of shafts 66 are connected to drive unit 39, and they penetrate through cooling plate 16 and extend in the direction of ice-making unit 300. Through-holes in cooling plate 16 are provided with water sealing members 33 for sealing spaces around shafts 66. In addition, drive unit 39 is provided with ice detector shaft 144 disposed on the side thereof, and ice detecting lever 145 is mounted to ice detector shaft 144. Drive unit 39 is also provided with driving shaft 54 on the front side.

Drive unit 39 includes therein at least one driving component, though not shown in the figures, for driving shafts 66, ice detector shaft 144 and driving shaft 54

Cooling plate 16 is provided with temperature detection means such as temperature sensor 35.

Insulating materials 147 and 148 for covering heater 141 and temperature sensor 35 are placed around ice-making vessel 503.

Ice-making vessel 503, cooling plate 16, water sealing member 30, drive unit 39, cooling accelerate member 140, heater 141, supporting members 142 and 143, shafts 66, water sealing members 33, ice detector shaft 144, ice detecting lever 145, driving shaft 54, temperature sensor 35 and insulating materials 146 and 147 are secured one another to compose ice-making device 37 as a whole.

Cooling accelerate member 140 is located in an area confronting a cold air port inside of a refrigerator's ice-making compartment (not shown).

Ice-making device 37 is placed inside the ice-making compartment in a manner that its upper portion is housed in a space of generally a dome-shaped concaved portion formed in the top surface of the compartment. Insulating materials 146 and 147 are closely located to the concaved portion in the top surface of the compartment to an utmost extent without interfering rotation of ice-making device 37 while minimizing circulation of the air through ice-making unit 300 and the ice-making compartment. The top surface of the ice-making compartment is equipped with heating means inside the concaved portion, though not shown in the figures.

The ice-making device constructed as above operates and functions in a manner which is described hereinafter.

When the ice-making control begins and temperature sensor 35 detects a temperature within a predetermined range, water is supplied by the water supply means and stored in a space of ice-making unit 300 bounded by ice-making vessel 503 and cooling plate 16. Ice-making vessel 503 has an open bottom from where cooling plate 16 is exposed.

The water stored in ice-making unit 300 does not leak out because of water sealing member 30 placed between ice-making vessel 503 and cooling plate 16. Water sealing members 33 disposed around shafts 66 also prevent the water from leaking out of ice-making unit 300.

Water sealing members 33 are formed of a rubber-like elastic material into an annular shape.

These water sealing members 33 have one or more stages of fin-like configuration formed along their inner perimeters, and their inner diameters are smaller than the outer diameter of shafts 66. Moreover, the inner perimeters of water sealing members 33 are coated with grease to further improve the waterproofing property.

When temperature sensor 35 detects a temperature rise of cooling plate 16 and determines that the water supply is completed, driving shaft 54 starts repeating a normal-to-reverse rotation at a given frequency and a given amplitude to swing ice-making device 37, and moderately stirs the water supplied inside ice-making unit 300. In this embodiment, driving shaft 54 is fixed to the ice-making compartment, so that the rotation of driving shaft 54 causes ice-making device 37 itself to make a swinging motion.

An ambient temperature surrounding ice-making unit 300 is kept higher than 0 deg-C., since a concaved portion in top surface of the ice-making compartment is heated by a heating means, and insulating materials 146 and 147 isolate ice-making unit 300 from the inner air of the ice-making compartment. Cooling accelerate member 140 is cooled by chilled air delivered into the ice-making compartment, and cools cooling plate 16. When cooling plate 16 reaches a freezing temperature, it starts freezing the supplied water gradually from the bottom side while dispelling gaseous components in the water upward. The top surface of the supplied water will never freeze before the bottom surface since the ambient temperature around ice-making unit 300 is kept higher than 0 deg-C. through this duration. Temperature sensor 35 keeps monitoring a temperature of cooling plate 16. The monitored temperature is used for regulating a voltage applied to heater 141 appropriately or switching the power supply to heater 141. The optimum freezing speed is controlled in this manner by regulating the temperature of cooling plate 16. When the freezing speed is faster than the degassing speed, for instance, the voltage applied to heater 141 is increased. This further enhances the degassing effect of the swinging operation, that is, the effect of dispelling gaseous components in the water. At this time, unfrozen water inside ice-making vessel 503 is freely movable across an entire width thereof.

Completion of the ice-making is determined when the temperature detected by temperature sensor 35 becomes lower than a predetermined temperature after an elapse of a predetermined time following the end of water supply. A generally plank-shaped ice block of comparatively high clarity is produced by this time in ice-making vessel 503.

The swinging operation stops upon completion of the freezing, and ice detector shaft 144 moves ice detecting lever 145 downward into the ice storage box placed inside the ice-making compartment. If the ice storage box contains ice chips of an amount exceeding a predetermined level, ice detecting lever 145 touches the ice and its turning movement obstructed so as to determine that the box is full with the ice. If the ice storage box contains ice chips of a lesser amount than the predetermined level, on the other hand, ice detecting lever 145 finds the amount of ice not sufficient.

The ice block is kept as it is in ice-making vessel 503 when the storage box is full. Ice detecting lever 145 is activated thereafter at regular intervals to monitor the amount of ice chips in ice storage box. Heater 141 is energized when the ice becomes deficient, to start heating cooling plate 16. This heat of cooling plate 16 loosens the ice block bound to cooling plate 16 inside ice-making vessel 503.

Power supply to heater 141 is terminated when temperature sensor 35 detects a temperature above a predetermined value. Driving shaft 54 is driven to turn ice-making unit 300 upside down, and shafts 66 are then rotated to crack the ice block into a plurality of chips and to let them fall into the ice storage box. After completion of cracking the ice block, shafts 66 are returned to their original positions, and ice-making unit 300 is returned to the horizontal position by driving driving-shaft 54.

The ice-making control returns to the start thereafter.

As described above, an ice-making device equipped with a cooling plate having a heating capability can be realized with a comparatively simple structure and at low cost by adopting ice-making device 37 of this exemplary embodiment.

Since the heater is covered with insulating materials on all surfaces other than the one in contact with the cooling plate, it has a low loss of heat, and is capable of bringing up a temperature of the cooling plate to the predetermined level within a short time by its comparatively small heating capacity.

In this exemplary embodiment, description provided also included the method of making sensually excellent block of ice with good clarity for use in whiskey and water and the like. However, the method described here is not meant to exclude other methods of ice-making.

Twelfth Exemplary Embodiment

Figure 25:
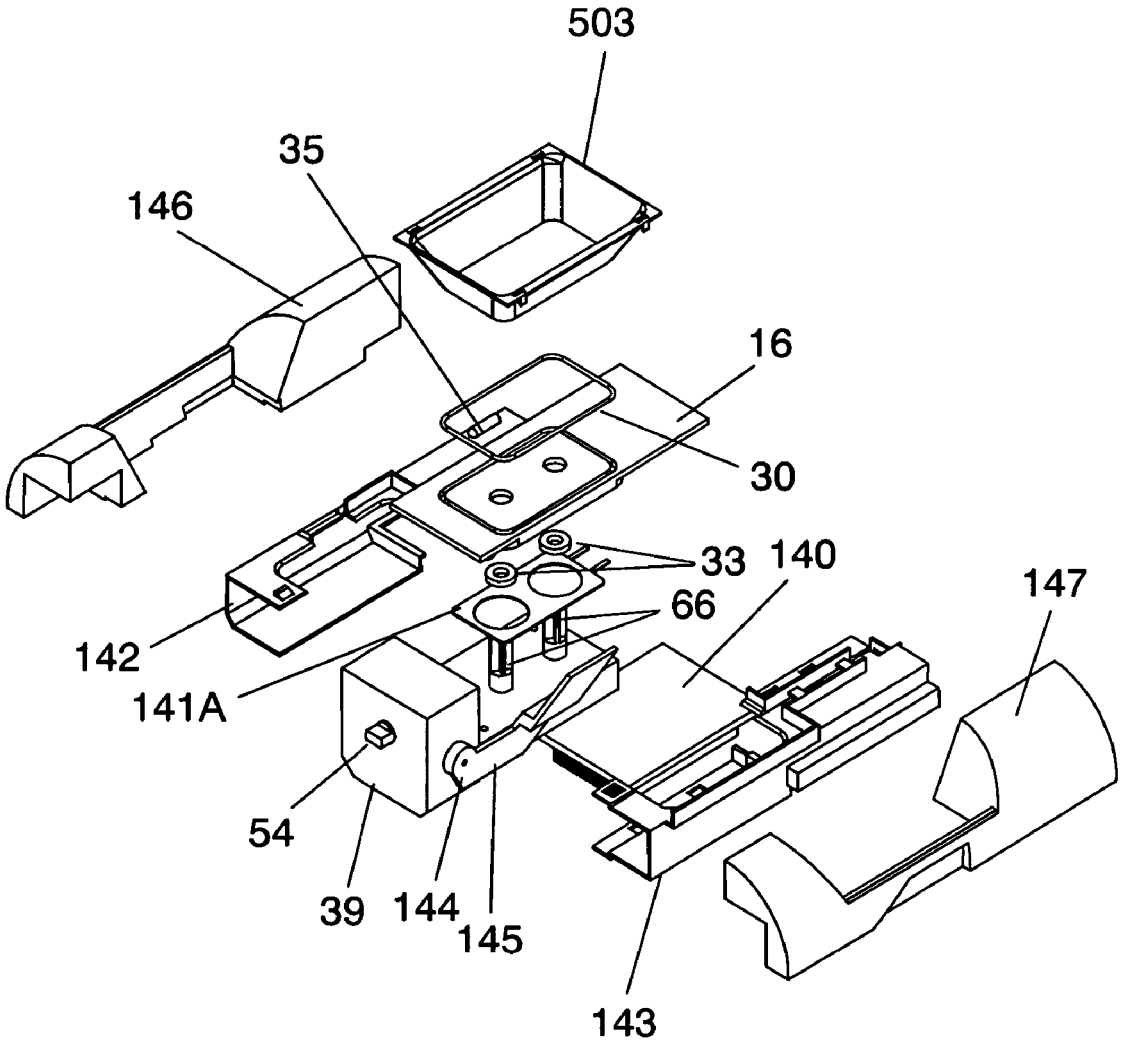
FIG. 25 is an exploded perspective view of an ice-making device according to a twelfth exemplary embodiment by this invention.

Description is provided of the twelfth exemplary embodiment with reference to FIG. 25.

Detailed description will be skipped for like components as those of the eleventh exemplary embodiment.

Ice-making unit 300 comprises ice-making vessel 503 having an open top and open bottom for temporarily storing water and making a plank-shaped block of ice, cooling plate 16, and water sealing member 30 disposed between outer flange of ice-making vessel 503 and cooling plate 16.

Drive unit 39 is disposed underneath cooling plate 16.

Cooling accelerate member 140 having a fin configuration is disposed behind drive unit 39 and under cooling plate 16 in a manner to make close contact to cooling plate 16. Both cooling plate 16 and cooling accelerate member 140 are formed of a material of good thermal conductivity such as aluminum.

In addition, flat-type heater 141A capable of generating substantially uniform heat is disposed between cooling plate 16 and drive unit 39 in a location corresponding to the bottom of ice-making vessel 503, for the purpose of heating cooling plate 16. The flat-type heater for generating substantially uniform heat may be the one comprised of a metal resistor sandwiched between insulators formed of silicone rubber or the like, another one comprised of a heater made of a conductive resin also sandwiched between insulators, or the like component. They have relatively high flexibility in design of configuration.

A plurality of shafts 66 are connected to drive unit 39, and they penetrate through cooling plate 16 and extend in the direction of ice-making unit 300. Through-holes in cooling plate 16 are provided with water sealing members 33 for sealing spaces around shafts 66. Flat-type heater 141A has holes cut open in areas corresponding to shafts 66 for them to penetrate through.

The ice-making device constructed as above operates and functions in a manner which is described hereinafter.

The water supplied by water supply means is cooled by cooling plate 16 inside ice-making vessel 503, and becomes frozen.

When temperature sensor 35 detects completion of the freezing, flat-type heater 141A is energized to heat cooling plate 16 and loosen the ice block bound to cooling plate 16. Since flat-type heater 141A generates substantially uniform heat and heats the bottom surface of ice-making vessel 503 generally uniformly, the ice block is not likely to melt unevenly.

Although temperature sensor 35 monitors a temperature of only one spot of cooling plate 16 for determination of terminating the heating, this uniformity of temperature distribution throughout cooling plate 16 can ensure the end of heating at the optimum temperature to loosen the ice block bound to cooling plate 16 without melting.

As described above, the ice-making device of this twelfth exemplary embodiment has a flat-type heater placed between the cooling plate and the drive unit in the location corresponding to the bottom of the ice-making vessel for generating substantially uniform heat. This heater can prevent a partial over-melting of the ice block due to heating of the cooling plate. It also helps terminate the heating at the optimum temperature to loosen the ice block bound to the cooling plate.

In this exemplary embodiment, the flat-type heater is disposed between the cooling plate and the drive unit. However, like advantageous effect can be achieved by using a conventional heating wire instead of the flat-type heater, with addition of a relatively simple structure, in which a groove is formed in at least one of the cooling plate and the drive unit for installation of the heating wire.

TABLE 1A

| Embodied Sample Number | Total Water (Depth) | Vessel Bottom Area | Number of Feedings | Amount of each Feeding | Swing Angle | Swing Frequency | Freezing Time | Clarity |
|---|---|---|---|---|---|---|---|---|
| 1 | 100 ml (20 ml) | 40 mm | 20 times | 4.5 ml | ±15 deg | 5 c/m | 80 min | D |
| 2 | 100 ml (20 ml) | 40 mm | 20 times | 4.5 ml | ±15 deg | 5 c/m | 120 min | C |
| 3 | 160 ml (20 ml) | 60 mm | 20 times | 7 ml | ±15 deg | 5 c/m | 120 min | B |
| 4 | 160 ml (20 ml) | 60 mm | 40 times | 3.5 ml | ±15 deg | 5 c/m | 120 min | D |
| 5 | 160 ml (20 ml) | 60 mm | 10 times | 15 ml | ±15 deg | 5 c/m | 120 min | B |
| 6 | 160 ml (20 ml) | 60 mm | 1 time | — | ±15 deg | 5 c/m | 120 min | C |
| 7 | 160 ml (20 ml) | 60 mm | 20 times | 7 ml | ±10 deg | 5 c/m | 120 min | C |
| 8 | 160 ml (20 ml) | 60 mm | 20 times | 7 ml | ±5 deg | 5 c/m | 120 min | D |
| 9 | 160 ml (20 ml) | 60 mm | 20 times | 7 ml | ±15 deg | 2 c/m | 120 min | D |
| 10 | 160 ml (20 ml) | 60 mm | 20 times | 7 ml | ±15 deg | 15 c/m | 120 min | D |
| 11 | 160 ml (20 ml) | 60 mm | 20 times | 7 ml | ±15 deg | 5 c/m | 240 min | A |
| 12 | 112 ml (15 ml) | 60 mm | 13 times | 7 ml | ±15 deg | 5 c/m | 120 min | A |

TABLE 1A-continued

| Embodied Sample Number | Total Water (Depth) | Vessel Bottom Area | Number of Feedings | Amount of each Feeding | Swing Angle | Swing Frequency | Freezing Time | Clarity |
|---|---|---|---|---|---|---|---|---|
| 13 | 112 ml (15 ml) | 60 mm | 1 time | — | ±15 deg | 5 c/m | 120 min | B |
| 14 | 112 ml (15 ml) | 60 mm | 1 time | — | 0 deg | — | 120 min | D |
| 15 | 112 ml (15 ml) | 60 mm | 1 time | — | 0 deg | — | 240 min | C |
| 16 | 200 ml (25 ml) | 60 mm | 1 time | — | ±15 deg | 5 c/m | 120 min | D |
| 17 | 160 ml (20 ml) | 60 mm | 20 times | 7 ml | ±15 deg | 10 c/m | 120 min | C |
| 18 | 160 ml (20 ml) | 60 mm | 30 times | 4.5 ml | ±15 deg | 5 c/m | 120 min | C |

TABLE 1B

| Embodied Sample Number | Total Water (Depth) | Vessel Bottom Area | Number of Feedings | Amount of each Feeding | Swing Angle | Swing Frequency | Freezing Time | Clarity |
|---|---|---|---|---|---|---|---|---|
| 14 | 112 ml (15 ml) | 60 mm | 1 time | — | 0 deg | — | 120 min | D |
| 15 | 112 ml (15 ml) | 60 mm | 1 time | — | 0 deg | — | 240 min | C |

TABLE 1C

| Embodied Sample Number | Total Water (Depth) | Vessel Bottom Area | Number of Feedings | Amount of each Feeding | Swing Angle | Swing Frequency | Freezing Time | Clarity |
|---|---|---|---|---|---|---|---|---|
| 13 | 112 ml (15 ml) | 60 mm | 1 time | 112 ml | ±15 deg | 5 c/m | 120 min | B |
| 6 | 160 ml (20 ml) | 60 mm | 1 time | 160 ml | ±15 deg | 5 c/m | 120 min | C |
| 16 | 200 ml (25 ml) | 60 mm | 1 time | — | ±15 deg | 5 c/m | 120 min | D |

TABLE 1D

| Embodied Sample Number | Total Water (Depth) | Vessel Bottom Area | Number of Feedings | Amount of each Feeding | Swing Angle | Swing Frequency | Freezing Time | Clarity |
|---|---|---|---|---|---|---|---|---|
| 2 | 100 ml (20 ml) | 40 mm | 20 times | 4.5 ml | ±15 deg | 5 c/m | 120 min | C |
| 3 | 160 ml (20 ml) | 60 mm | 20 times | 7 ml | ±15 deg | 5 c/m | 120 min | B |

TABLE 1E

| Embodied Sample Number | Total Water (Depth) | Vessel Bottom Area | Number of Feedings | Amount of each Feeding | Swing Angle | Swing Frequency | Freezing Time | Clarity |
|---|---|---|---|---|---|---|---|---|
| 3 | 160 ml (20 ml) | 60 mm | 20 times | 7 ml | ±15 deg | 5 c/m | 120 min | B |
| 7 | 160 ml (20 ml) | 60 mm | 20 times | 7 ml | ±10 deg | 5 c/m | 120 min | C |
| 8 | 160 ml (20 ml) | 60 mm | 20 times | 7 ml | ±5 deg | 5 c/m | 120 min | D |

TABLE 1F

| Embodied Sample Number | Total Water (Depth) | Vessel Bottom Area | Number of Feedings | Amount of each Feeding | Swing Angle | Swing Frequency | Freezing Time | Clarity |
|---|---|---|---|---|---|---|---|---|
| 9 | 160 ml (20 ml) | 60 mm | 20 times | 7 ml | ±15 deg | 2 c/m | 120 min | D |
| 3 | 160 ml (20 ml) | 60 mm | 20 times | 7 ml | ±15 deg | 5 c/m | 120 min | B |
| 17 | 160 ml (20 ml) | 60 mm | 20 times | 7 ml | ±15 deg | 10 c/m | 120 min | C |
| 10 | 160 ml (20 ml) | 60 mm | 20 times | 7 ml | ±15 deg | 15 c/m | 120 min | D |

TABLE 1G

| Embodied Sample Number | Total Water (Depth) | Vessel Bottom Area | Number of Feedings | Amount of each Feeding | Swing Angle | Swing Frequency | Freezing Time | Clarity |
|---|---|---|---|---|---|---|---|---|
| 6 | 160 ml (20 ml) | 60 mm | 1 time | — | ±15 deg | 5 c/m | 120 min | C |
| 5 | 160 ml (20 ml) | 60 mm | 10 times | 15 ml | ±15 deg | 5 c/m | 120 min | B |
| 3 | 160 ml (20 ml) | 60 mm | 20 times | 7 ml | ±15 deg | 5 c/m | 120 min | B |
| 18 | 160 ml (20 ml) | 60 mm | 30 times | 4.5 ml | ±15 deg | 5 c/m | 120 min | C |
| 4 | 160 ml (20 ml) | 60 mm | 40 times | 3.5 ml | ±15 deg | 5 c/m | 120 min | D |

INDUSTRIAL APPLICABILITY

The ice-making device of the present invention has an ice-making unit for making a plank-shaped block of ice, and cracking means for cracking the plank-shaped ice block into a plurality of chips, thereby providing sharp-cut ice chips rather than round-edge cubes. The device can broadly satisfy the need of ice chips with varied shapes for ice makers, refrigerators and the like of not only household use but also commercial use. Usefulness of the ice-making device of this invention is unlimitedly wide because of a high commercial value of the device beside the attractiveness of the high clarity of ice chips.

The invention claimed is:

1. An ice-making device comprising:

an ice-making unit provided with an ice-making vessel for making a plank-shaped block of ice;

cracking means for cracking the plank-shaped block of ice produced in the ice-making unit into a plurality of irregularly-shaped ice chips within the ice-making unit;

a drive unit for driving the cracking means;

a water supply unit for supplying water to the ice-making vessel;

a turning unit for turning the ice-making unit upside down; and an ice storage box for storing the plurality of irregularly-shaped ice chips, wherein the cracking means is disposed to a bottom side of the ice-making vessel, and the turning unit turns the ice-making vessel and the cracking means upside down upon completion of the ice making to allow the ice chips in the ice-making vessel to fall into the ice storage box.

2. The ice-making device according to claim 1, wherein the cracking means cracks the plank-shaped block of ice by providing a stress internally thereon.

3. The ice-making device according to claim 1 further comprising a drive unit for driving the cracking means, and the cracking means comprises a shaft driven and rotated by the drive unit.

4. The ice-making device according to claim 3, wherein the shaft is provided with a plurality of ribs extending generally radially from a rotating axis of the shaft.

5. The ice-making device according to claim 4, wherein the ribs are formed in a manner that a protruding length in the radial direction is longer at the bottom side is than a length at the upper side.

6. The ice-making device according to claim 3, wherein the shaft is inserted in advance in the ice-making vessel before the water inside the ice-making vessel freezes.

7. The ice-making device according to claim 6, wherein a height of the shaft in horizontal plane is taller than a height of the ice made in the ice-making vessel.

8. The ice-making device according to claim 6, wherein a height of the shaft in horizontal plane is shorter than a height of the ice made in the ice-making vessel.

9. The ice-making device according to claim 3, wherein the shaft is inserted through the bottom of the ice-making vessel.

10. The ice-making device according to claim 9, wherein the shaft is placed over outer periphery of a cylindrical post mounted to the bottom of the ice-making vessel, and connected with the drive unit through the interior of the cylindrical post.

11. The ice-making device according to claim 3, wherein the cracking means is provided with a plurality of shafts, and the drive unit rotates the plurality of shafts simultaneously.

12. The ice-making device according to claim 11, wherein each of the plurality of shafts has a rib formed substantially in alignment with another along a line connecting a rotating axes of the adjoining shafts, and the plurality of shafts are driven in the same rotating direction.

13. The ice-making device according to claim 11, wherein each of the plurality of shafts has a rib formed substantially in alignment with another along a line connecting a rotating axes of the adjoining shafts, and the plurality of shafts are driven in different rotating directions with respect to one another.

14. The ice-making device according to claim 3, wherein the shaft is formed of a metal.

15. The ice-making device according to claim 3, wherein the shaft is formed of a polymeric resin.

16. The ice-making device according to claim 1, wherein the ice-making unit is fixed to the cracking means, and the ice-making unit and the cracking means swing around a horizontal turning shaft when ice is being made.

17. The ice-making device according to claim 1, wherein the ice-making vessel has sidewalls sloped in a direction to make a top plane larger in area than an area of a bottom plane.

18. The ice-making device according to claim 1 further comprising a turning unit for turning the ice-making unit upside down, wherein the cracking means is driven to crack the plank-shaped block of ice into the plurality of irregularly-shaped ice chips after the ice-making is completed and the ice-making unit is turned upside down.

19. The ice-making device according to claim 18, wherein the cracking means is driven further for a predetermined time duration while the ice-making unit is in the upside-down position.

20. The ice-making device according to claim 18, wherein the cracking means is for driving a shaft to rotate in one direction when cracking the block of ice, and the cracking means drive the shaft in the same direction as that for cracking the ice for a predetermined time duration after the cracking but before supplying water to the ice-making unit.

21. The ice-making device according to claim 18, wherein the ice-making unit is turned upside down and the cracking means is driven after the ice-making is completed and the bottom surface of the ice-making vessel is heated.

22. The ice-making device according to claim 18, wherein the bottom surface of the ice-making vessel is cooled to a predetermined temperature following completion of releasing the ice chips from the ice-making vessel but before starting the supply of water.

23. The ice-making device according to claim 18, wherein an ice storage box is disposed under the ice-making unit for storing ice chips, and further wherein the ice-making unit is turned upside down and the shaft is driven, after the ice-making is completed and an amount of the ice chips in the ice storage box is determined and found less than a predetermined level.

24. The ice-making device according to claim 23, wherein a temperature of the ice-making vessel is controlled to be 0 deg-C. or below when an amount of the ice chips in the ice storage box is found to satisfy the predetermined level.

25. The ice-making device according to claim 1 further comprising a turning unit for turning the ice-making unit upside down, wherein the ice-making unit is turned upside down after the ice-making is completed and the cracking means is driven to crack the plank-shaped block of ice into the plurality of irregularly-shaped ice chips.

26. The ice-making device according to claim 1 further comprising a turning unit for turning the ice-making unit upside down, wherein the cracking means is driven to crack the plank-shaped block of ice into the plurality of irregularly-shaped ice chips when the ice-making is completed, while turning the ice-making unit upside down.

27. The ice-making device according to claim 1, wherein the plank-shaped block of ice made by the ice-making unit has a high clarity.

28. The ice-making device according to claim 27 further comprising a swinging mechanism for swinging the ice-making vessel during ice-making, wherein the swinging mechanism causes the water to flow while being frozen into the plank-shaped block of ice.

29. The ice-making device according to claim 28, wherein the swinging is carried out at a frequency of 3 to 10 cycles per minute from the start to the completion of ice-making.

30. The ice-making device according to claim 28, wherein an angle of the swinging is in a range of ±10 degrees and ±20 degrees.

31. The ice-making device according to claim 28, wherein the swinging is paused for a duration of 3 to 7 seconds at a point of the largest swinging angle.

32. The ice-making device according to claim 27, wherein the water supply unit supplies the water to the ice-making vessel intermittently in a plural number of times using intermittent water supply means.

33. The ice-making device according to claim 27 further comprising heating means under the ice-making vessel, wherein the heating means heats a bottom surface of the ice-making vessel to a predetermined temperature following completion of releasing the ice chips but before starting the supply of water.

34. The ice-making device according to claim 27, wherein the ice-making vessel has sidewalls sloped in a direction to make a top plane larger in area than an area of a bottom plane, and the sloped surfaces have any angle between 10 and 39 degrees.

35. The ice-making device according to claim 34, wherein the sidewalls of the ice-making vessel are partly bent inward.

36. The ice-making device according to claim 1, wherein a temperature of a bottom surface of the ice-making vessel is regulated using temperature detection means mounted to the ice-making unit in a manner to gradually decrease from the start of ice-making.

37. The ice-making device according to claim 1 further having a cooling plate formed of a metal of good thermal conductivity for cooling the ice-making vessel.

38. The ice-making device according to claim 37, wherein a surface temperature of the cooling plate is regulated using temperature detection means mounted to the ice-making unit in a manner to decrease the temperature of the cooling plate gradually from the start of ice-making.

39. The ice-making device according to claim 38 further having a control unit for power supply to the Peltier device, wherein a polarity of voltage applied to the Peltier device is reversed to switch between cooling and heating when a predetermined time has elapsed after the start of ice-making.

40. The ice-making device according to claim 37, wherein the cooling plate is cooled by using a Peltier device.

41. The ice-making device according to claim 37, wherein the cooling plate is provided with a heater for controlling an ambient temperature of the ice-making vessel.

42. The ice-making device according to claim 1 further provided with heating means for controlling an ambient temperature of the ice-making vessel.

43. The ice-making device according to claim 1, wherein the ice-making unit is provided with a heater for heating.

44. The ice-making device according to claim 43, wherein the heater comprises a flat-type heater for generating substantially uniform heat throughout a surface thereof.

* * * * *